US011105570B2

(12) United States Patent
Mather

(10) Patent No.: US 11,105,570 B2
(45) Date of Patent: Aug. 31, 2021

(54) BOLT FOR BOLT ACTION RIFLES

(71) Applicant: Sturm, Ruger & Company, Inc., Southport, CT (US)

(72) Inventor: Jonathan Philip Mather, Grafton, NH (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 16/661,304

(22) Filed: Oct. 23, 2019

(65) Prior Publication Data

US 2020/0064089 A1 Feb. 27, 2020

Related U.S. Application Data

(63) Continuation of application No. 15/846,802, filed on Dec. 19, 2017, now Pat. No. 10,458,731, which is a (Continued)

(51) Int. Cl.
*F41A 3/22* (2006.01)
*F41A 3/30* (2006.01)
*F41A 9/41* (2006.01)

(52) U.S. Cl.
CPC *F41A 3/22* (2013.01); *F41A 3/30* (2013.01); *F41A 9/41* (2013.01)

(58) Field of Classification Search
CPC ..... F41A 3/22; F41A 9/41; F41A 3/16; F41A 3/18; F41A 3/20; F41A 3/24; F41A 3/30; F41A 3/74; F41A 5/24; F41A 5/30
(Continued)

(56) References Cited

U.S. PATENT DOCUMENTS 2,960,917 A 11/1960 Lizza
3,631,620 A 1/1972 Ohira
(Continued)

FOREIGN PATENT DOCUMENTS

DE 102010032592 2/2012
FR 1475055 3/1967
(Continued)

OTHER PUBLICATIONS

Instruction Manual for Ruger American Rifle, Bolt-Action Rifle, www.Ruger.com, pp. 1-40, Sturm, Ruger & Company, Inc., 411 Sunapee Street, Newport, NH 03773, 2013.
(Continued)

*Primary Examiner* — Bret Hayes
(74) *Attorney, Agent, or Firm* — The Belles Group, P.C.

(57) ABSTRACT

A bolt for a bolt-action firearm in one embodiment is movably disposed in a receiver between forward closed breech and rearward open breech axial positions. The bolt includes an operating handle and plurality of bolt lugs arranged to selectively engage locking lugs in the firearm. The bolt is rotatable between locked and unlocked breech positions when in the closed breech position. The bolt body has a dimensionally reduced middle section with unique configuration adapted to allow the bolt to rotate when closed without interference from the magazine feed lips. Using this design, the bolt may include three bolt lugs in one embodiment for secure lockup and minimal angular rotation between the locked and unlocked breech positions. The bolt is usable with both single and double stack box type magazines with one of the bolt lugs operating to reliably strip cartridges from either type magazine.

44 Claims, 27 Drawing Sheets

Related U.S. Application Data continuation of application No. 15/052,948, filed on Feb. 25, 2016, now Pat. No. 9,885,528.

(60) Provisional application No. 62/121,167, filed on Feb. 26, 2015.

(58) Field of Classification Search
USPC ..... 42/16
See application file for complete search history.

(56) References Cited

U.S. PATENT DOCUMENTS

| | | | | |
|---|---|---|---|---|
| H88 | H | 7/1986 | Savioli et al. | |
| 5,551,179 | A | 9/1996 | Young | |
| 6,000,161 | A | 12/1999 | Aalto | |
| 6,061,944 | A | 5/2000 | Schroeder | |
| 6,209,249 | B1 | 4/2001 | Borden | |
| D475,430 | S | 6/2003 | Wardle | |
| 6,609,319 | B1 | 8/2003 | Olson | |
| 6,978,709 | B2 | 12/2005 | Aalto et al. | |
| 7,735,410 | B2 | 6/2010 | Clark | |
| 7,930,968 | B2 | 4/2011 | Giefing | |
| 7,950,177 | B2 | 5/2011 | Laney et al. | |
| 7,971,379 | B2 | 7/2011 | Robinson et al. | |
| 8,302,340 | B1 * | 11/2012 | Irwin | F41A 3/22 42/16 |
| 8,307,750 | B2 | 11/2012 | Vuksanovich et al. | |
| 8,375,616 | B2 | 2/2013 | Gomez et al. | |
| 8,387,513 | B2 | 3/2013 | Gomez et al. | |
| 8,397,415 | B2 | 3/2013 | Laney et al. | |
| 8,397,623 | B2 | 3/2013 | Herring | |
| 8,745,911 | B2 | 6/2014 | Zheng | |
| 8,826,576 | B2 | 9/2014 | Lewis | |
| 8,844,182 | B2 | 9/2014 | Ibarguren | |
| 8,850,737 | B1 | 10/2014 | Rogers | |
| 2003/0066226 | A1 | 4/2003 | Martin | |
| 2005/0262752 | A1 | 12/2005 | Robinson et al. | |
| 2008/0000128 | A1 | 1/2008 | Newman | |
| 2010/0307042 | A1 | 12/2010 | Jarboe et al. | |
| 2012/0055058 | A1 | 3/2012 | Picard et al. | |
| 2012/0073177 | A1 * | 3/2012 | Laney | F42B 5/025 42/16 |
| 2012/0137869 | A1 | 6/2012 | Gomez et al. | |
| 2014/0013641 | A1 | 1/2014 | Warburton et al. | |
| 2014/0076144 | A1 | 3/2014 | Gomez | |
| 2014/0260946 | A1 | 9/2014 | Gomez | |
| 2015/0198394 | A1 * | 7/2015 | Hochstrate | F41A 3/66 42/17 |

FOREIGN PATENT DOCUMENTS

| | | |
|---|---|---|
| WO | 2007/101292 | 9/2007 |
| WO | 2014/036398 | 3/2014 |

OTHER PUBLICATIONS

Corresponding International Search Report and Written Opinion for PCT/US2016/019450 dated May 6, 2016. WO European Supplemental Search Report for related patent application No. EP 16756319.6 dated Jan. 21, 2019.

"Remington MSR Hands-On Review" by PrecisionRifleBlog.com dated Sep. 24, 2015; retrieved at https://precisionrifleblog.com/2015/09/24/remington-mst-hands-on-review/[Feb. 20, 2020 12:20:49 PM], 14 pages.

Photos of Remington PSR Kit bolt, as noted in online article "Remington MSR Hands-On Review" by PrecisionRifleBlog.com dated Sep. 24, 2015; retrieved at https://precisionrifleblog.com/2015/09/24/remington-mst-hands-on-review/[Feb. 20, 2020 12:20:49 PM], 12 photos.

* cited by examiner

BOLT FOR BOLT ACTION RIFLES

CROSS REFERENCE TO RELATED APPLICATIONS

The present application is a continuation of U.S. patent application Ser. No. 15/846,802 filed Dec. 19, 2017 (now U.S. Pat. No. 10,458,731), which is a continuation of U.S. patent application Ser. No. 15/052,948 filed Feb. 25, 2016 (now U.S. Pat. No. 9,885,528), which claims the benefit of priority to U.S. Provisional Patent Application No. 62/121,167 filed Feb. 26, 2015; the entireties of which are incorporated herein by reference.

BACKGROUND

The present invention generally relates to firearms, and more particularly to breech bolts for firearms.

Bolt action rifles comprise a manually retractable and rotatable bolt used to form a closed locked breech. The front end of the bolt is equipped with bolt lugs which rotatably engage mating locking lugs disposed at the rear of the barrel to form a locked breech for discharging the rifle and prevent escape of combustion gases. A bolt handle coupled to the bolt allows a user to rotate the bolt between locked and unlocked rotational positions, and to advance/retract the bolt between axial closed and open breech positions for loading/unloading cartridges from the breech chamber formed in the rear end of the barrel. Bolt action rifles typically feed cartridges from a single stack magazine. Accordingly, the ability to fully rotate the bolt between locked breech and unlocked breech positions while the bolt is in battery with the chamber is important.

Bolt action rifles typically have bolts with two or three locking lugs, although some designs may have more. The bolt lugs form the locked breech by engaging the corresponding locking lugs in the receiver or barrel at the rear of the barrel chamber once the bolt is manually rotated to overlap the mating locking surfaces (the bolt lugs being positioned in front of the locking lugs). Bolts with two lugs typically operate with the lugs in the horizontal or 3 o'clock and 9 o'clock position when the breech is locked, and rotate 90 degrees into the 6 and 12 o'clock positions when feeding cartridges into the breech. The bolt lug at the 6 'oclock position strips a fresh cartridge from the magazine and chambers the round. This geometry, however, is not conducive to feeding cartridges from double stack magazines, like used in the AR-15 style rifles as one example, because the round body of the bolt does not allow the lower front face of the bolt lug to extend far enough down in between the magazine feed lips necessary to reliably strip a cartridge from a double stack magazine when the action is cycled.

Bolts with three lugs typically feed cartridges with one of the lugs at the 6 o'clock position from a single stack magazine. One advantage of three lugs is that the bolt need not be rotated a full 90 degrees to lock and unlock the breech, thereby making it easier and less cumbersome for the user. These bolts often have bolt bodies substantially similar in diameter to the bolt lugs, and thus also do not allow enough cartridge contact to feed from double stack magazines like used in the AR-15 style rifles. In addition, these full diameter bolt bodies do not fit between the magazine feed lips thereby preventing the bolts from advancing far enough forward to strip a cartridge from the magazine in the first instance. The bolt body immediate behind the front bolt lugs would contact the rear of the magazine feed lips, preventing full forward motion of the bolt to close the breech.

Bolt designs used for AR-15 style rifles with double stack magazines do not provide a solution for the cartridge feed problem associated with manually rotated bolts used in bolt action rifles. In contrast to conventional one-piece bolts used in bolt action rifles, a significant difference is that AR-15 bolt assemblies have a two-piece construction comprised of an outer non-rotatable bolt housing (often called bolt carrier) that carries a rotatable bolt therein. Only the head of the bolt with exposed bolt lugs typically protrudes from the front end of the housing for lockup with the firearm's locking lugs to lock the breech. A camming mechanism automatically rotates the bolt independently of and in relation to the non-rotatable housing when the bolt housing is moved into or out of engagement with the locking lugs to lock or unlock the breech respectively.

Although the AR-15 bolt housings may sometimes have narrow longitudinal slots formed in the lower half of the bolt housing to avoid interference with the feed lips of double stack magazines, this design is not readily adaptable for use with one-piece solid bolt action rifle bolts because the bolt housing does not need to rotate when positioned over the magazine feed lips to lock the breech due to the independently rotating bolt.

An improved rotatable bolt design is desired that allows AR-15 double stack ammunition magazines to be used with bolt action rifles having three-lug bolts.

SUMMARY

Exemplary embodiments of the present invention provide a bolt for bolt action rifle which is configured to reliably feed cartridges from a double stack magazine. The bolt is configured with a novel profile to avoid interference with the magazine feed lips thereby allowing full rotation between locked and unlocked positions when the bolt is in battery with the barrel (i.e. closed breech). In one embodiment, the bolt body includes a reduced diameter middle section with specially angled/contoured surfaces in some embodiments to avoid the feed lips. The diameter reduction and angled surfaces are minimized and restricted primarily to the middle section so that a substantially full diameter body is retained in the front and rear sections for adequate bolt support and aesthetic considerations so that the angled surfaces are not visible to the user when the bolt is closed. In one embodiment, the bolt has a one-piece integral unitary structure formed from a solid piece of metal such as steel which is machined to form the desired external surface contours, bolt lugs, and various apertures necessary for a fully functioning bolt.

According to one aspect, a firearm with bolt assembly includes a longitudinal axis, a receiver defining a longitudinally extending cavity, a barrel supported by the receiver and including a rear end and a front end, an ammunition magazine removably disposed in the receiver and including a pair of feed lips for retaining a plurality of cartridges in the magazine; and a rotatable bolt disposed in the cavity and slideably movable forward to a closed position in battery with the barrel and rearward to an open position axially spaced apart from the barrel. The bolt includes: a plurality of bolt lugs selectively engageable with a plurality of locking lugs at the rear end of barrel; a bolt body including a front section, rear section, and middle section extending therebetween, the middle section comprising a dimensionally reduced portion of the bolt body having a smaller height and lateral width in transverse cross section than an outer diameter of the rear section; the middle section defining a downwardly and laterally open recess positioned over the feed lips of the magazine when the bolt is in the closed position, the recess receiving a portion of the feed lips therein; and a bolt handle disposed on one side of the rear section. The middle section of the bolt body provides clearance between the bolt body and feed lips of the magazine when the bolt is in the closed position so that the bolt is rotatable between a locked breech position and unlocked breech position.

According to another aspect, a firearm with bolt assembly includes a longitudinal axis, a receiver defining a longitudinally extending cavity, a barrel supported by the receiver and including a rear end and a front end, an ammunition magazine removably disposed in the receiver and including a pair of laterally spaced apart feed lips for retaining a stack of cartridges in the magazine, and a rotatable bolt disposed in the cavity and slideably movable forward to a closed breech position in battery with the barrel and rearward to an open breech position axially spaced apart from the barrel. The bolt includes: a longitudinal centerline; a front section having an outer diameter, a rear section having an outer diameter, and a middle section extending therebetween, the middle section comprising a dimensionally reduced section of the bolt having a smaller height than the outer diameters of the front and rear section; the middle section defining a downwardly and laterally open recess positioned over the feed lips of the magazine when the bolt is in the closed breech position, the recess receiving a portion of the feed lips therein; a plurality of bolt lugs selectively engageable with a plurality of locking lugs at the rear end of barrel, the bolt being rotatable between a locked breech position in which the bolt lugs engage the locking lugs and unlocked breech position in which the bolt lugs disengage the locking lugs when the bolt is in the closed position; a bolt handle disposed on one side of the rear section for manually moving the bolt between the open and closed positions; the front section of the bolt including a downwardly extending projecting defining an axially oriented bottom stub surface, and the middle section of the bolt including an axially oriented elongated bottom surface. One of the bolt lugs defines a feed lug axially aligned with the stub surface, the feed lug and stub surface each being dimensioned and operable to pass axially forward and rearward between the feed lips of the magazine when the bolt is moved between the open and closed breech positions. The middle section of the bolt provides clearance between the bolt body and feed lips of the magazine when the bolt is in the closed position to enable the bolt to rotate between a locked and unlocked breech positions.

A method for operating a bolt-action firearm is provided. The method includes: providing a firearm including a receiver, a barrel supported by the receiver and having an axial bore, locking lugs at a rear end of the barrel, and a bolt comprising a plurality of bolt lugs, the bolt axially movable in the receiver between a forward closed breech position in battery with the barrel and a rearward open breech position axially spaced apart from the barrel; providing a magazine inserted in the receiver and including an upwardly biased cartridge into the receiver, the cartridge retained in the magazine by a pair of spaced apart feed lips; the bolt initially being in the closed breech position and a rotational locked breech position in which the bolt lugs are engaged with the locking lugs; rotating the bolt in a first direction to disengage the bolt lugs from the locking lugs, the bolt being in an unlock breech position; retracting the bolt rearwards towards the open breech position; engaging a downwardly extending operating projection on the bolt with the cartridge; pushing the cartridge downward in the magazine with the operating projection; sliding the operating projection between the feed lips of the magazine; thereafter sliding one of the bolt lugs defining a feed lug between the feed lips of the magazine; positioning the feed lug behind the cartridge; advancing the bolt forward towards the closed breech position; engaging the feed lug with a rear end of the cartridge; sliding the feed lug between the feed lips of the magazine to push the cartridge forward into the barrel; and thereafter sliding the operating projection between the feed lips of the magazine.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The features of the preferred embodiments will be described with reference to the following drawings where like elements are labeled similarly, and in which.

Figure 1A:
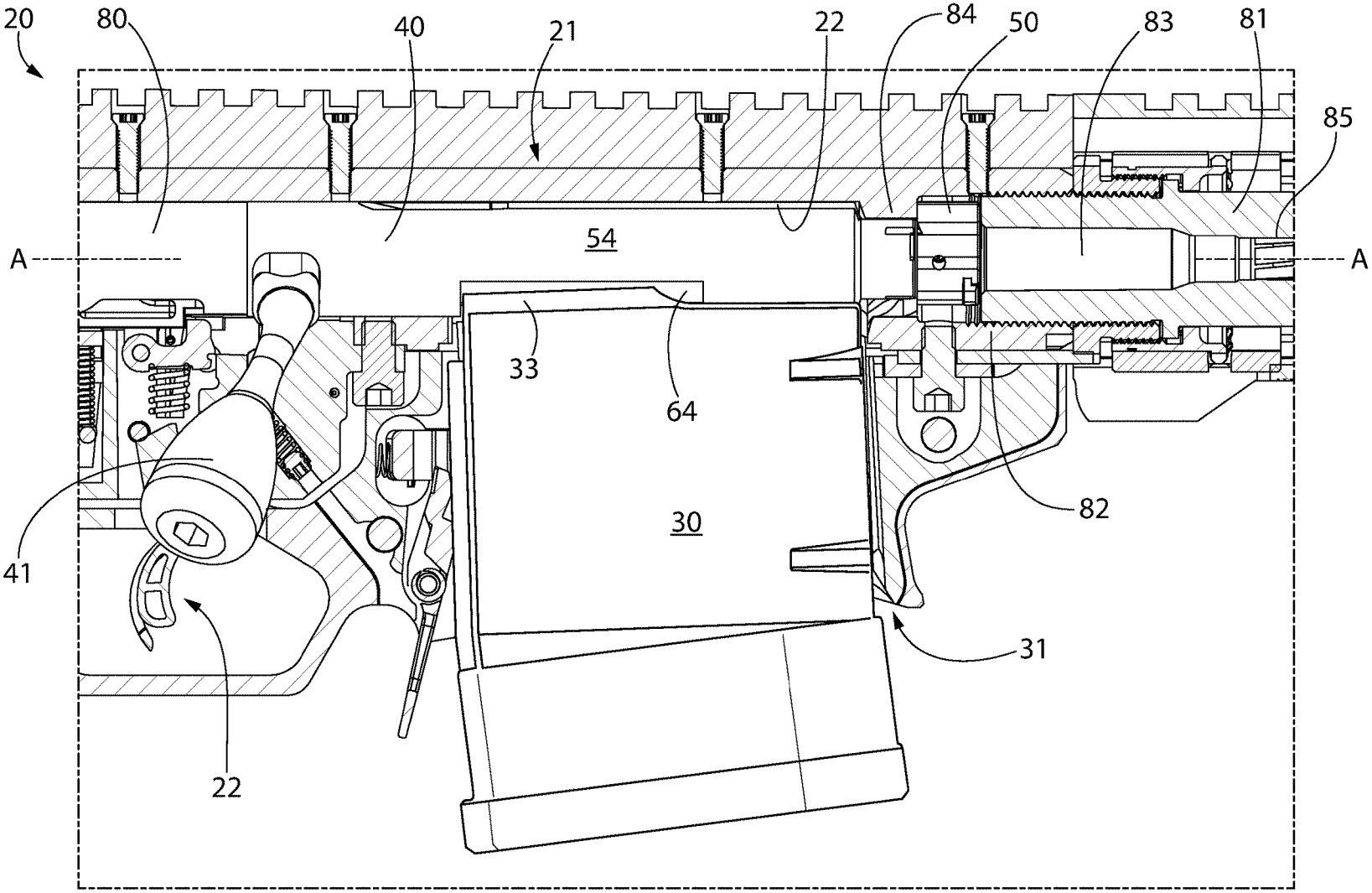
FIG. 1A is right side longitudinal cross sectional view of a receiver having a bolt assembly according to the present disclosure including a bolt, bolt rear extension, and operating handle, the bolt is shown in the locked breech position.

All drawings are schematic and not necessarily to scale.

DETAILED DESCRIPTION

The features and benefits of the invention are illustrated and described herein by reference to exemplary ("example") embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, ranges are used as shorthand for describing each and every value that is within the range. Any value within the range can be selected as the terminus of the range.

Figure 1B:
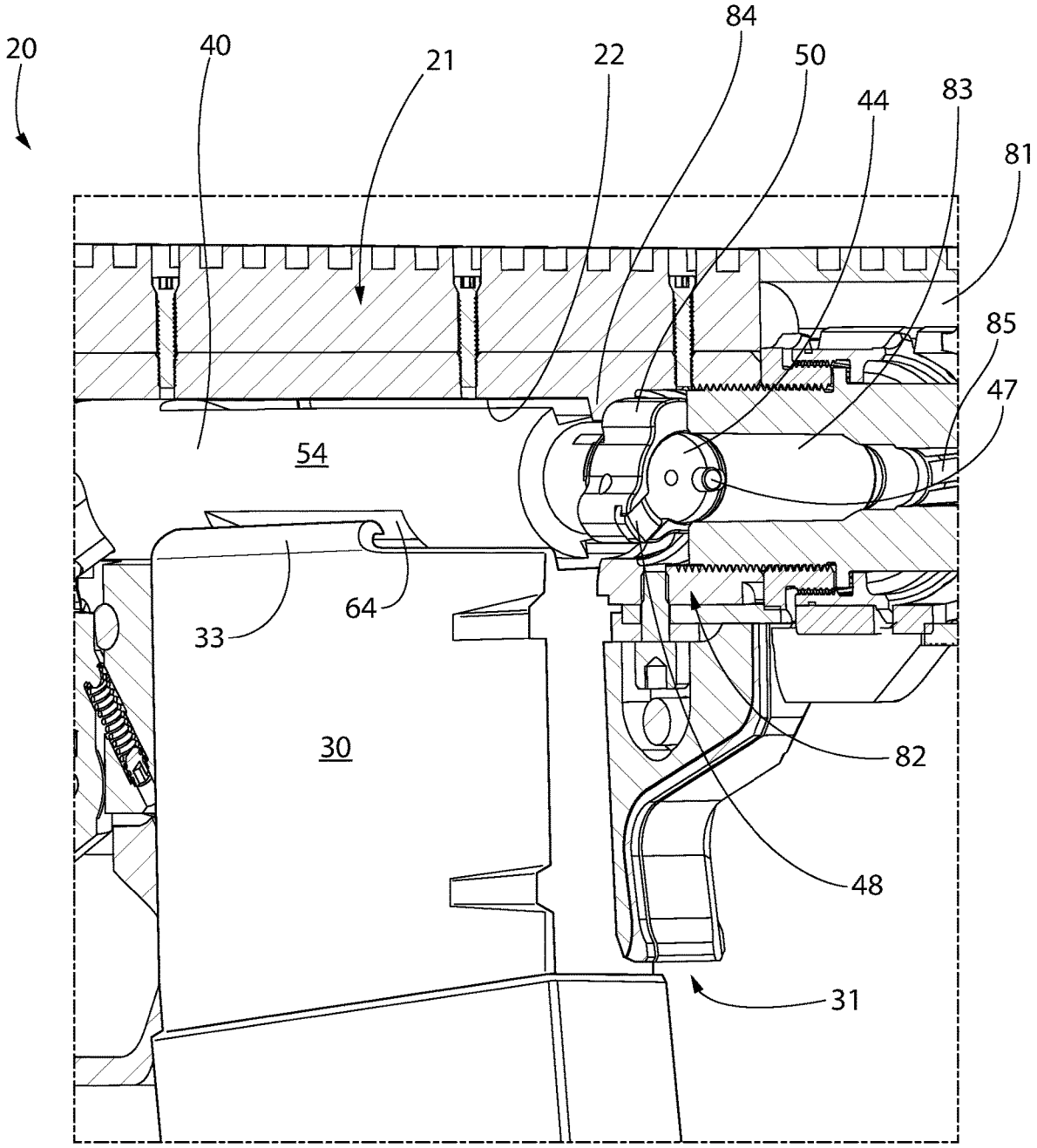
FIG. 1B is a right side longitudinal cross-sectional perspective view thereof.
Figure 1C:
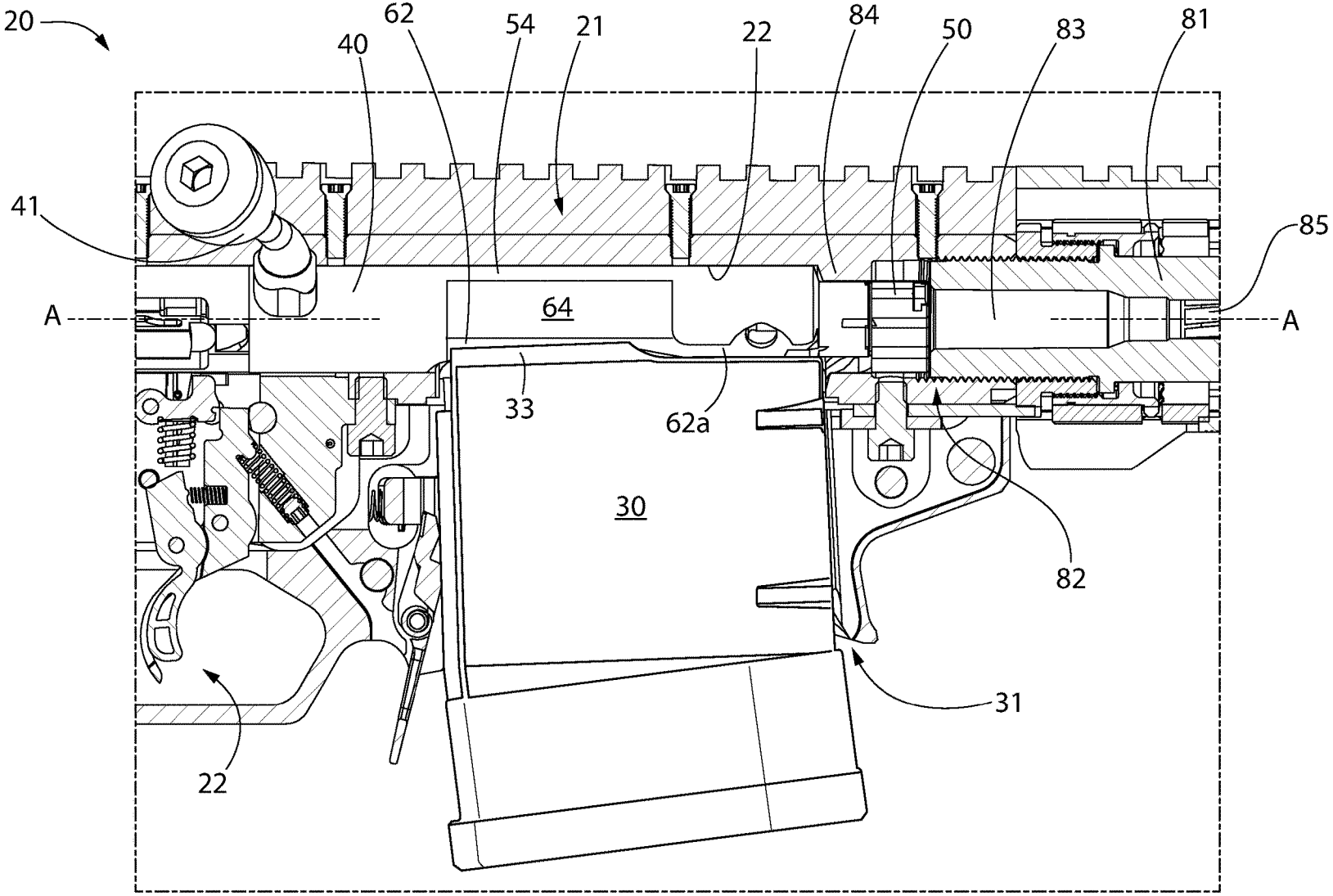
FIG. 1C is a right side cross-sectional view thereof showing the bolt in the unlocked breech position.
Figure 2:
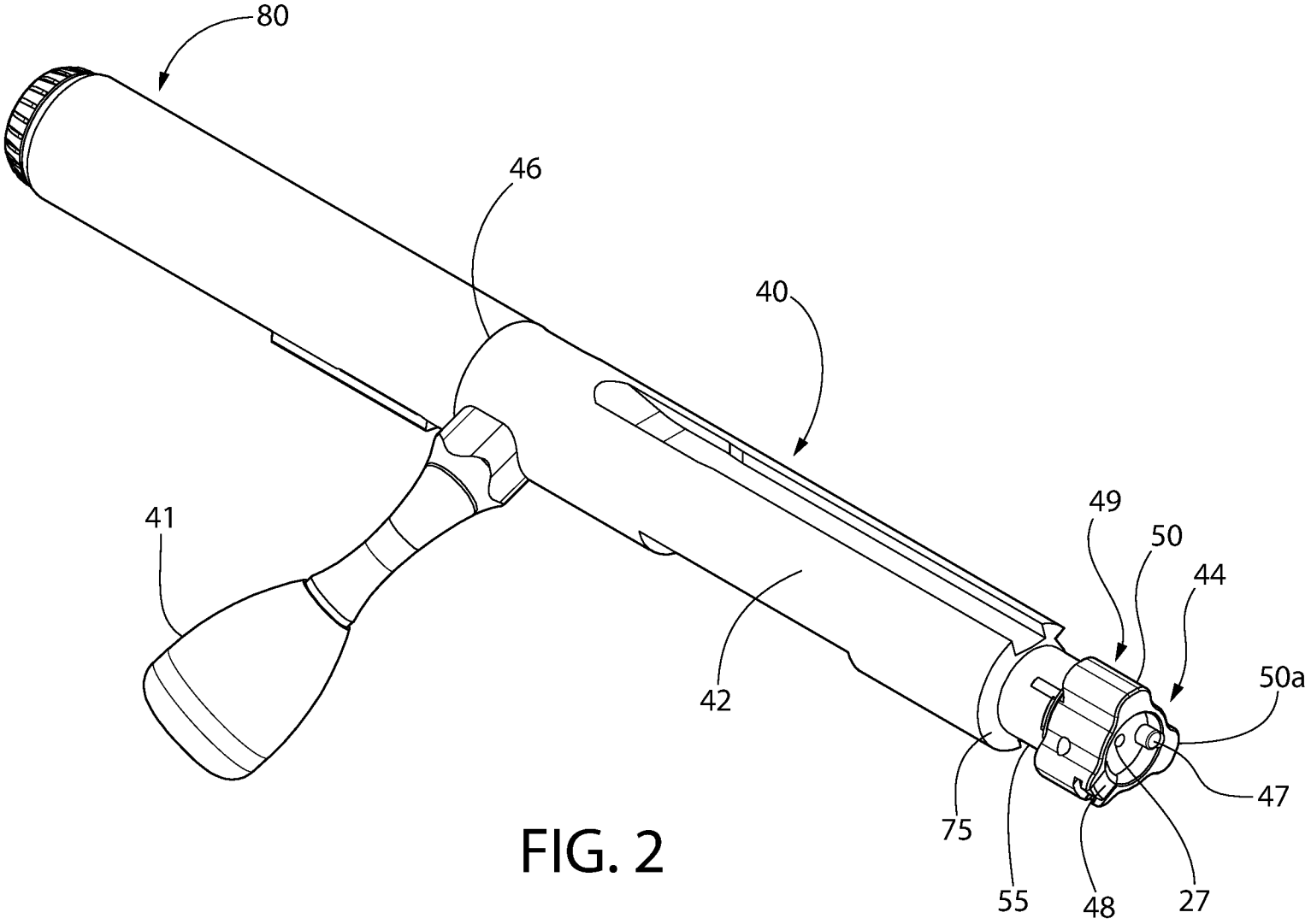
FIG. 2 is a top perspective view of the bolt assembly of FIG. 1.
Figure 3:
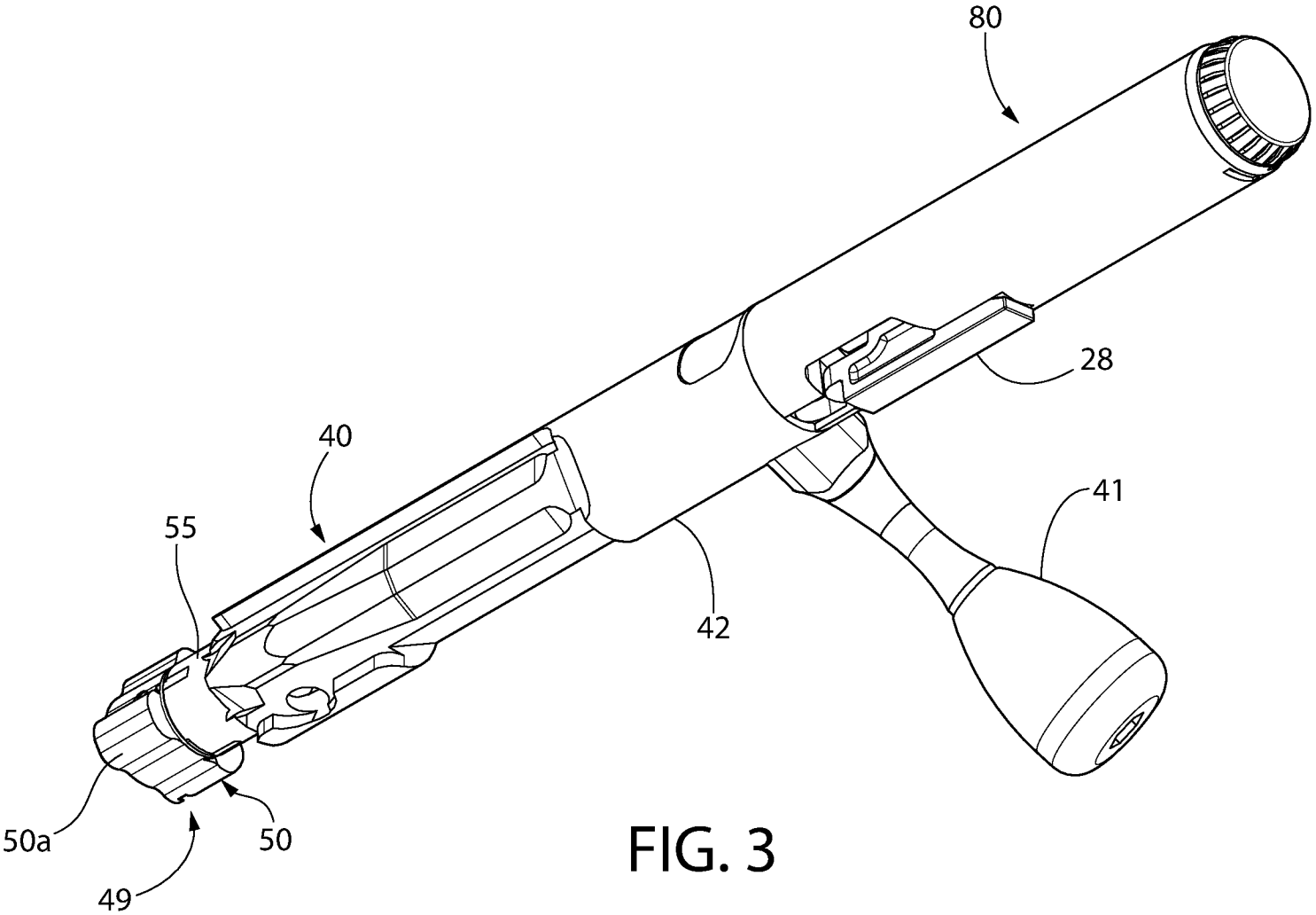
FIG. 3 is a bottom perspective view thereof.
Figure 4:
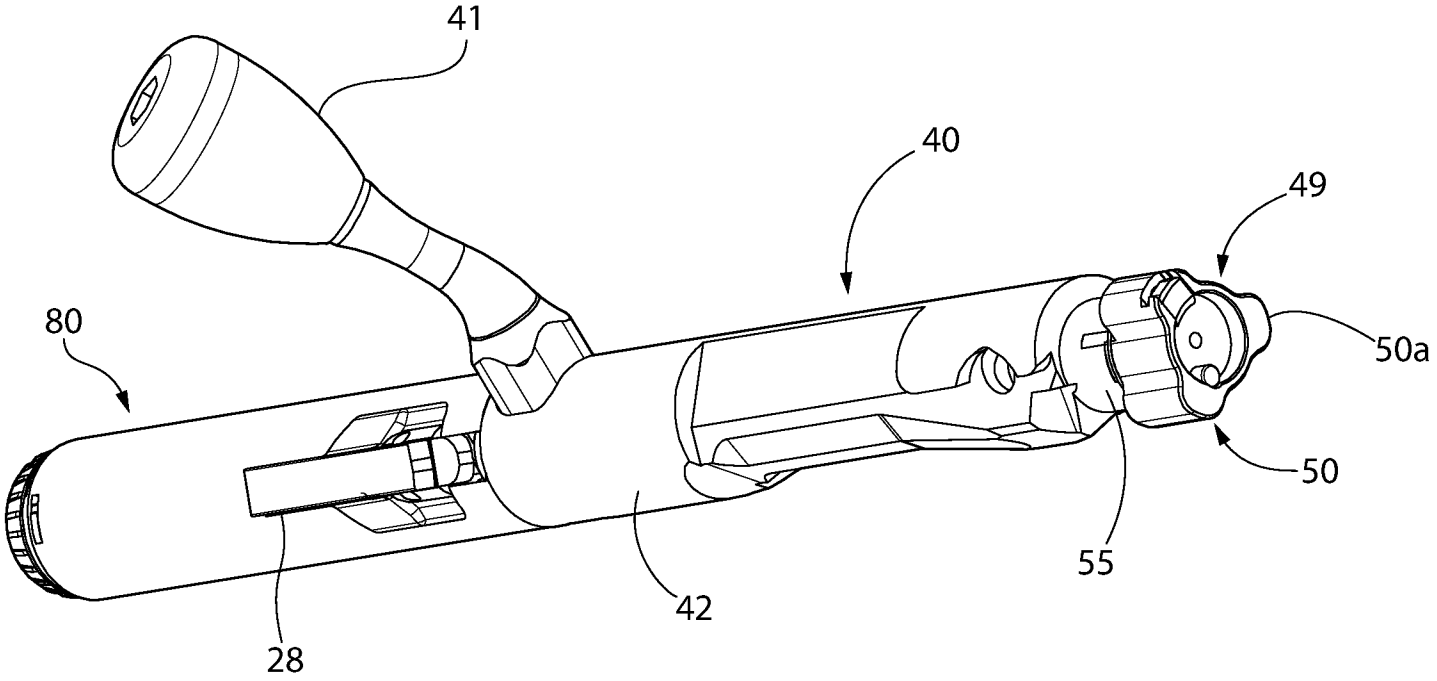
FIG. 4 is a right side perspective view thereof.
Figure 5:
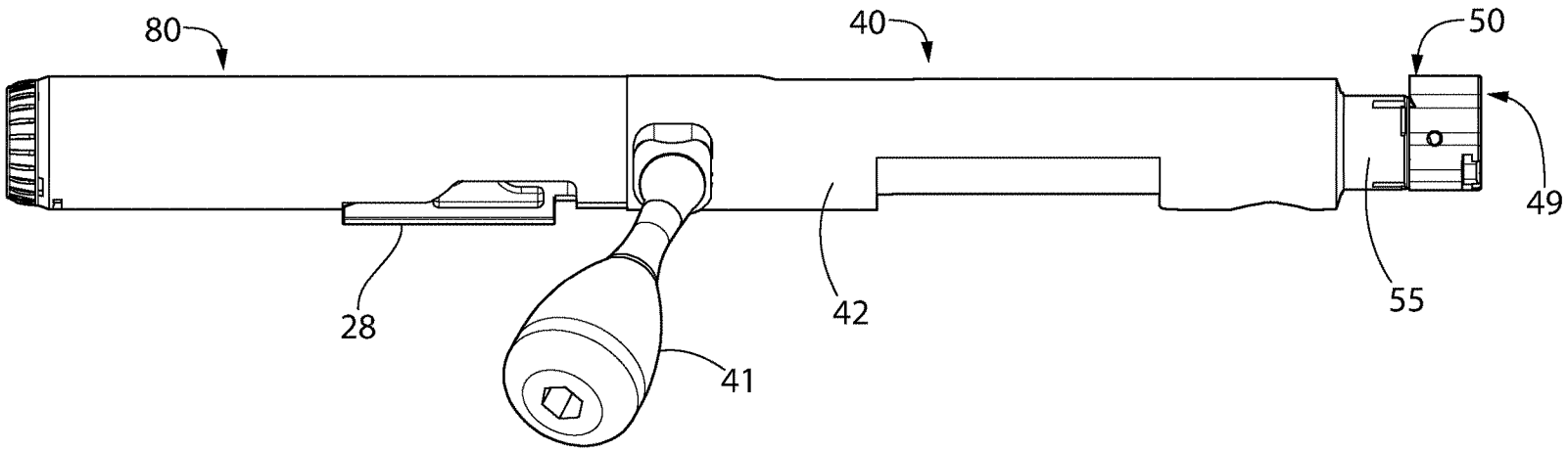
FIG. 5 is a top rotated view thereof.
Figure 6:
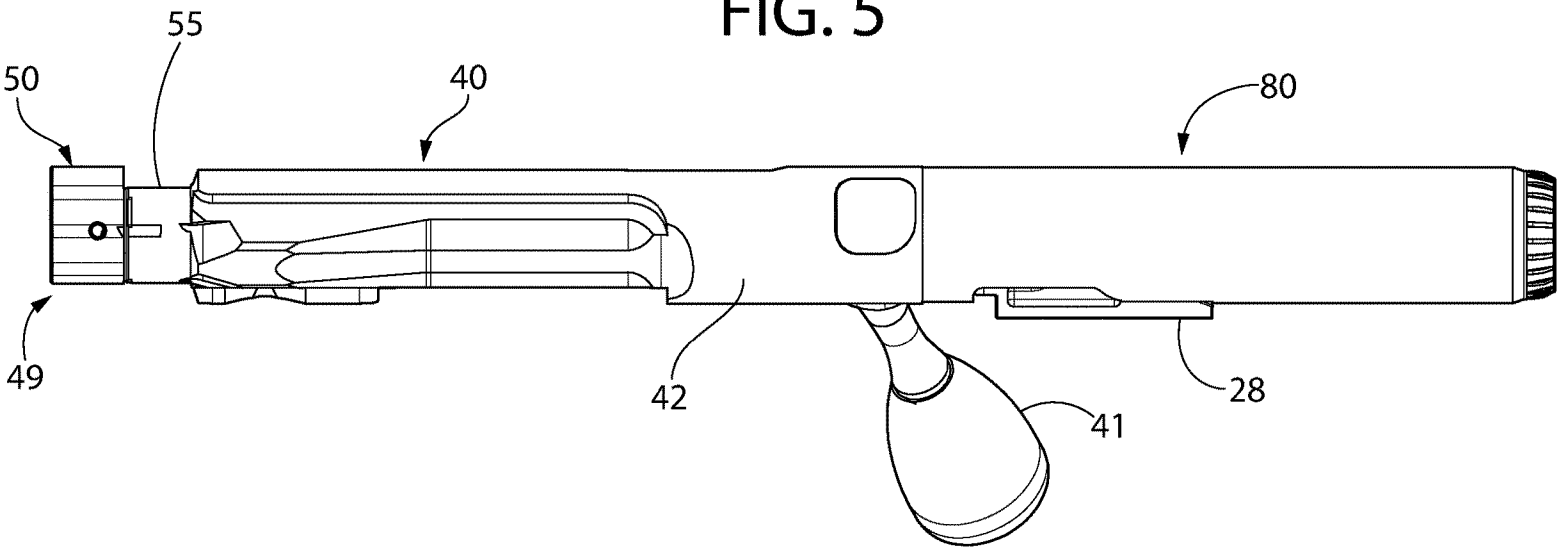
FIG. 6 is a left side rotated view thereof showing a portion of the bottom.
Figure 7:
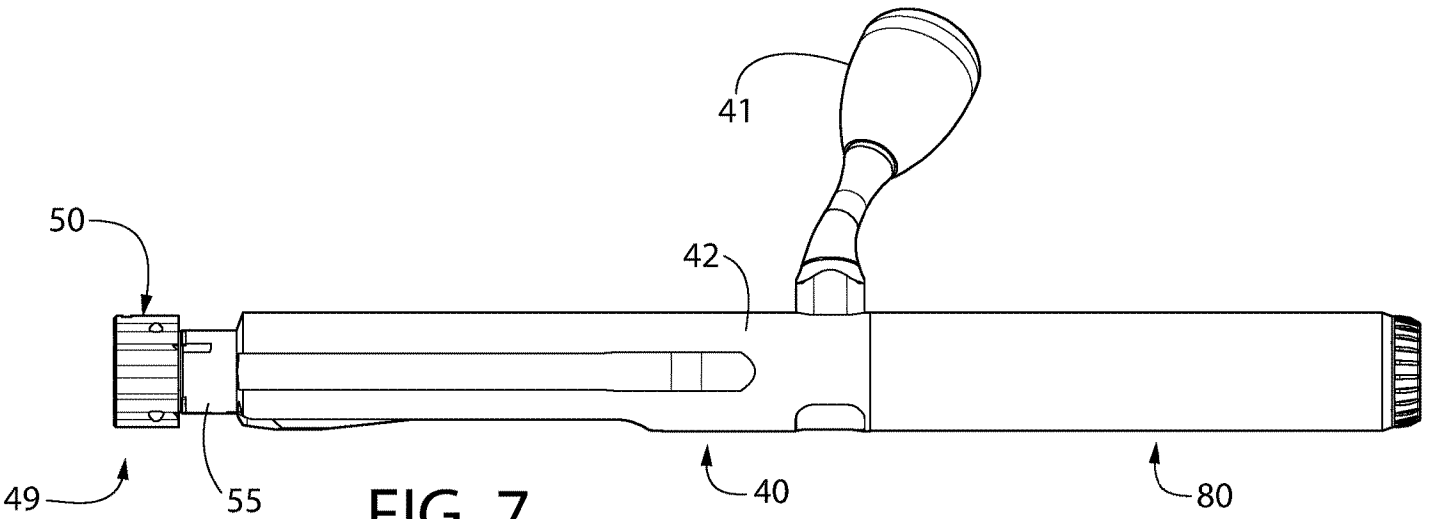
FIG. 7 is a left side view thereof.
Figure 8:
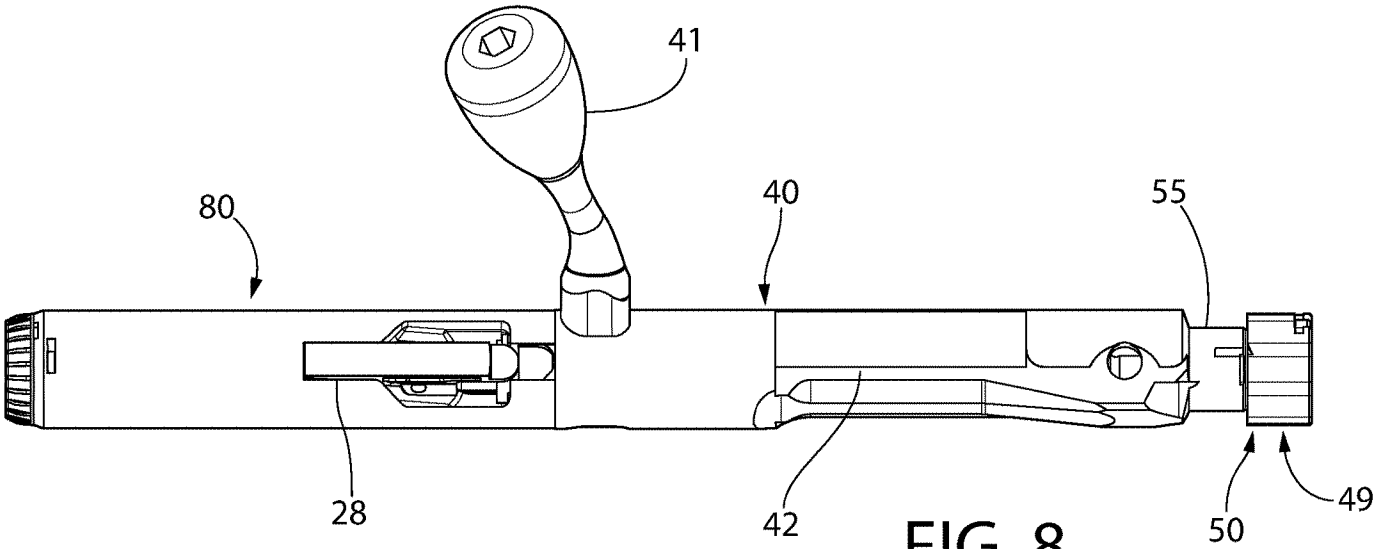
FIG. 8 is a right side rotated view thereof.
Figure 9:
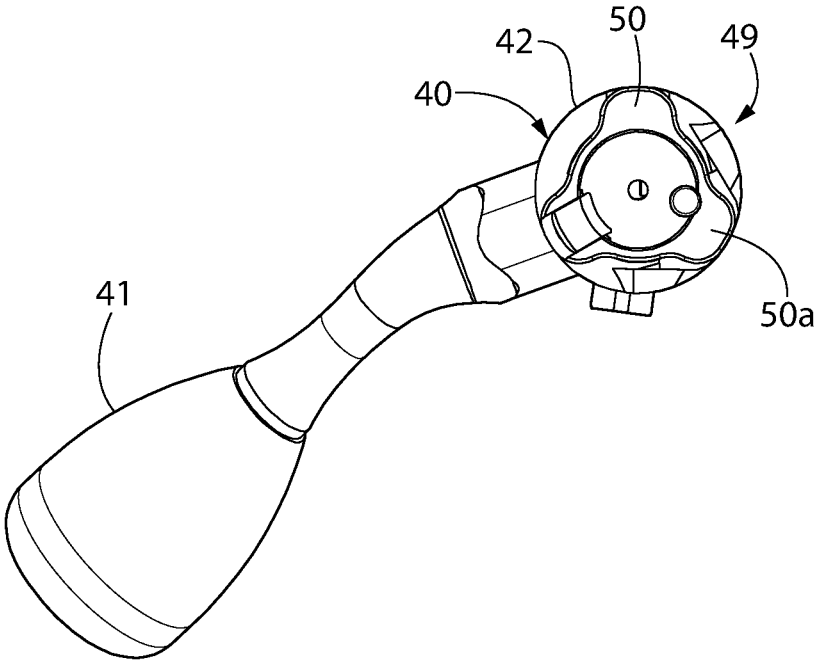
FIG. 9 is front end view thereof with bolt assembly rotated into unlocked breech position.
Figure 10:
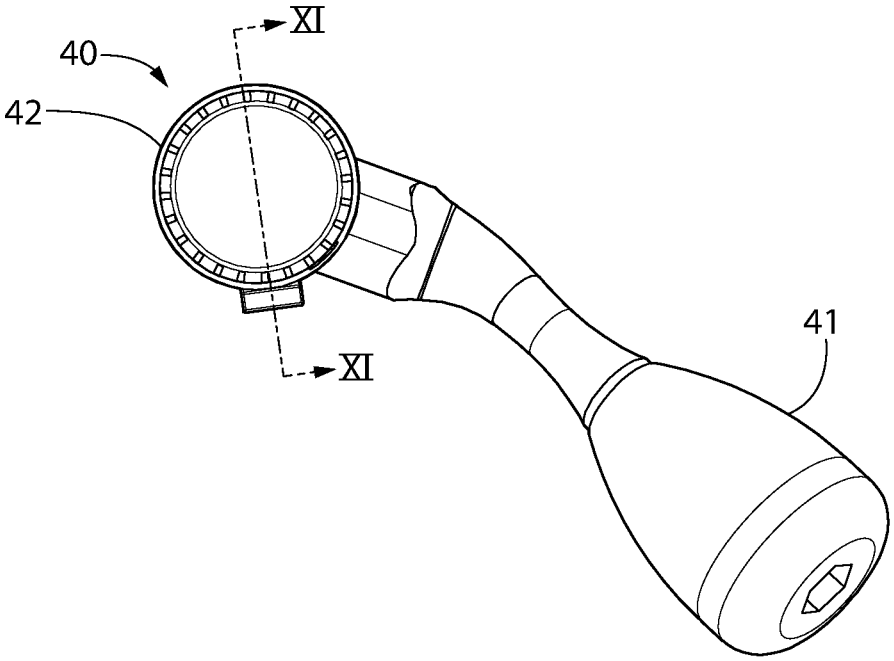
FIG. 10 is a cross-sectional view of the bolt assembly looking forward.

FIGS. 1A-C are various right side longitudinal cross-sectional views of the receiver portion of a bolt action rifle 20 having a bolt assembly according to the present disclosure. FIGS. 1A and 1B show a rotational locked breech position of the bolt and FIG. 1C shows a rotational unlocked breech position of the bolt.

The rifle 20 includes a longitudinal axis A-A, receiver 21, barrel 81 coupled thereto, bolt 40, trigger-actuated firing mechanism 22 supported by the receiver, and ammunition magazine 30 detachably mounted to the receiver in a downwardly open magazine well 31. In one non-limiting embodiment, the magazine 30 may be a double stack type configured for holding two vertical staggered columns of cartridges C (FIGS. 26-29) as is well known in the art. Such magazines are often used with the "AR" genre of rifles (i.e. ArmaLite rifles) such as AR-15 or AR-10 rifles, and others including the M-14. Construction of the bolt 40 according to the present disclosure advantageously allows use of a double stack magazine with bolt action rifles having a three bolt lug design. In other embodiments, a single stack type of magazine in which the cartridges are all vertically aligned with each other may be used with the specially configured bolt disclosed herein. Accordingly, the invention is not limited in its applicability to double stack magazines alone. The present magazine can advantageously also provide more reliable feeding with single stack magazines because it increases the bolt engagement (i.e. feed lug) with the cartridge while feeding by allowing the magazine to be positioned higher in the magazine well relative to the bolt.

With additional reference to FIGS. 26-29, magazine 30 is a hollow structure and includes a pair of laterally spaced apart feed lips 33 disposed adjacent the top opening 34 of the magazine. Fresh cartridges C may be manually loaded into the magazine 30 through the top opening (when the magazine is removed from the firearm) and dispensed from the magazine by operation of the bolt 40. Feed lips 33 prevent the cartridges C from being ejected from the top of magazine by the spring-loaded magazine follower (not shown) positioned beneath the stack of cartridges inside the magazine in a known manner.

An axially extending internal cavity 22 is formed in receiver 21 which is configured for slideable mounting of the bolt 40 therein. Bolt 40 is manually operated and provided with a bolt handle 41 which is secured to one lateral side of the bolt via mounting aperture 41*a*. Handle 41 is used for rotating the bolt 40 with respect to the receiver 21 between locked breech and unlocked breech positions. Bolt 40 is further used to axially slide the bolt 40 forward and rearward to close or open the breech respectively (also referred to as the "action").

Figure 12:
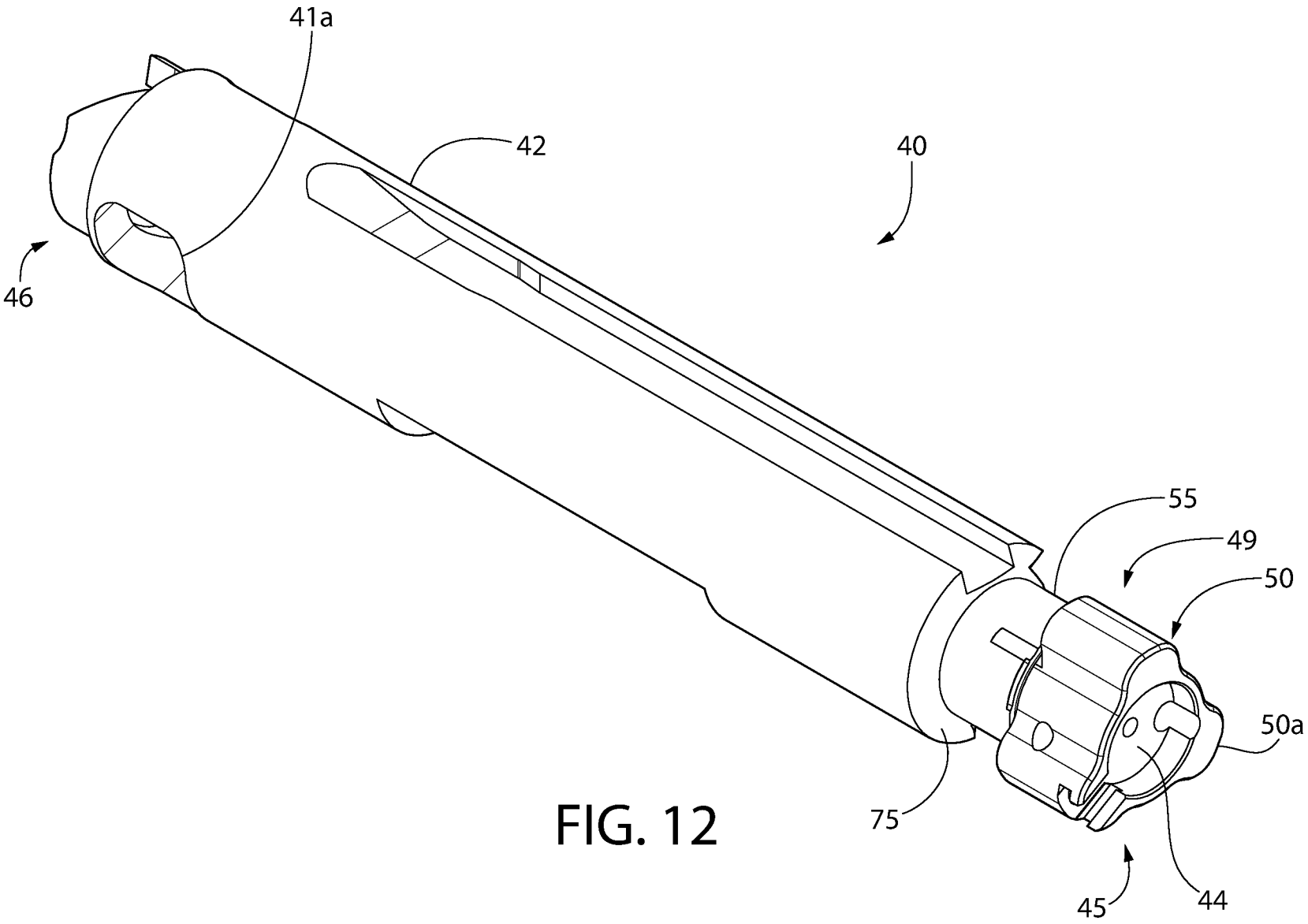
FIG. 12 is a left side perspective view of the bolt body (bolt) only of FIG. 1.
Figure 13:
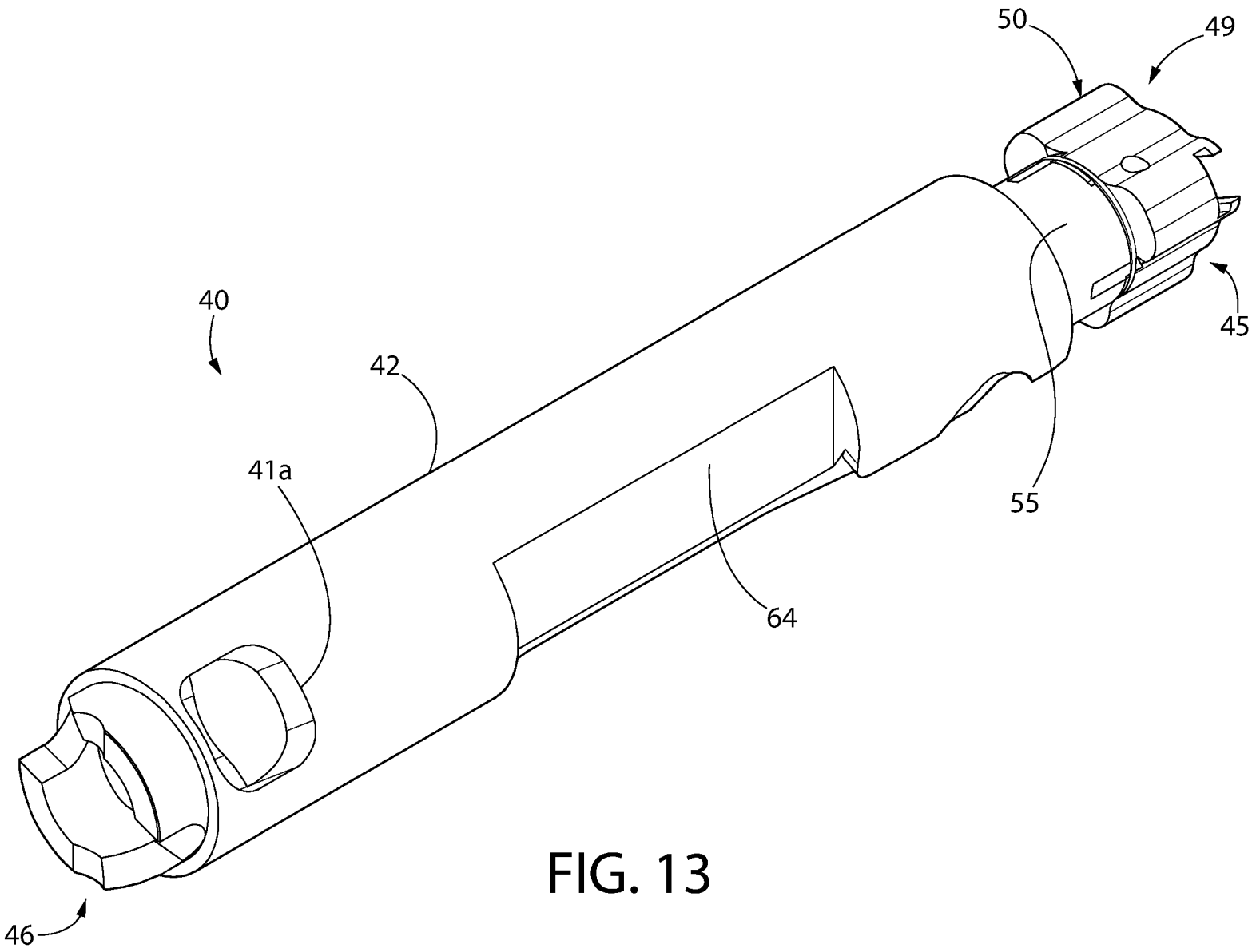
FIG. 13 is a top perspective view thereof.

Barrel 81 includes an axial bore 85 extending from a rear breech end 82 to a front muzzle end (not shown) from which a bullet or slug is discharged from the rifle. The rear breech end 82 of the barrel 81 defines a rearwardly open chamber 83 configured for holding a cartridge C. Breech end 82 includes a plurality of circumferentially spaced apart radial breech locking lugs 84 projecting inward adjacent the open rear of the chamber. Locking lugs 84 are configured and arranged to engage the bolt lugs 50 (see, e.g. FIG. 12) for forming a locked breech as well known in the art, and further described herein. In the illustrated embodiment, the breech locking lugs 84 are formed in the receiver 21; however in other embodiments the locking lugs may be formed on the breech end 82 of the barrel 81 or an extension mounted thereon. Accordingly, the invention in no way is not limited by the location of locking lugs.

Referring now to FIGS. 2-11, the bolt assembly is shown disembodied from the rifle. The assembly generally includes the bolt 40, bolt handle 41 coupled thereto, and a separable rear extension 80 coupled to the rear end 46 of the bolt. The rear end 46 is configured for mounting the extension thereon, and may have any suitable type of coupling arrangement for this purpose. A firing pin holder 28 is disposed at the rear end 46 between the bolt 40 and rear extension 80. The rear end of the firing pin 24 is mounted to the holder which supports the rear of the firing pin in the bolt assembly.

FIGS. 12-25 show the bolt alone. Bolt 40 includes an axially elongated cylindrical body 42 defining an axial longitudinal centerline CL generally coaxially aligned with longitudinal axis A-A of rifle 20, a front end 45 defining a bolt head 49, a rear end 46, an internal channel 43 extending between the ends, a top longitudinal surface 56, a bottom longitudinal surface 57 and opposing lateral sidewalls surfaces 58. Bottom longitudinal surface 57 includes a downwardly open and axially elongated faceted longitudinal recess 59 arranged to be positioned over the cartridge feed lips 33 when the bolt is closed in battery with the barrel. Portions of the longitudinal recess 59 extend at least partially up into the lateral sidewall surfaces 58 forming opposing laterally open portions 59*a* of the recess.

Figure 11:
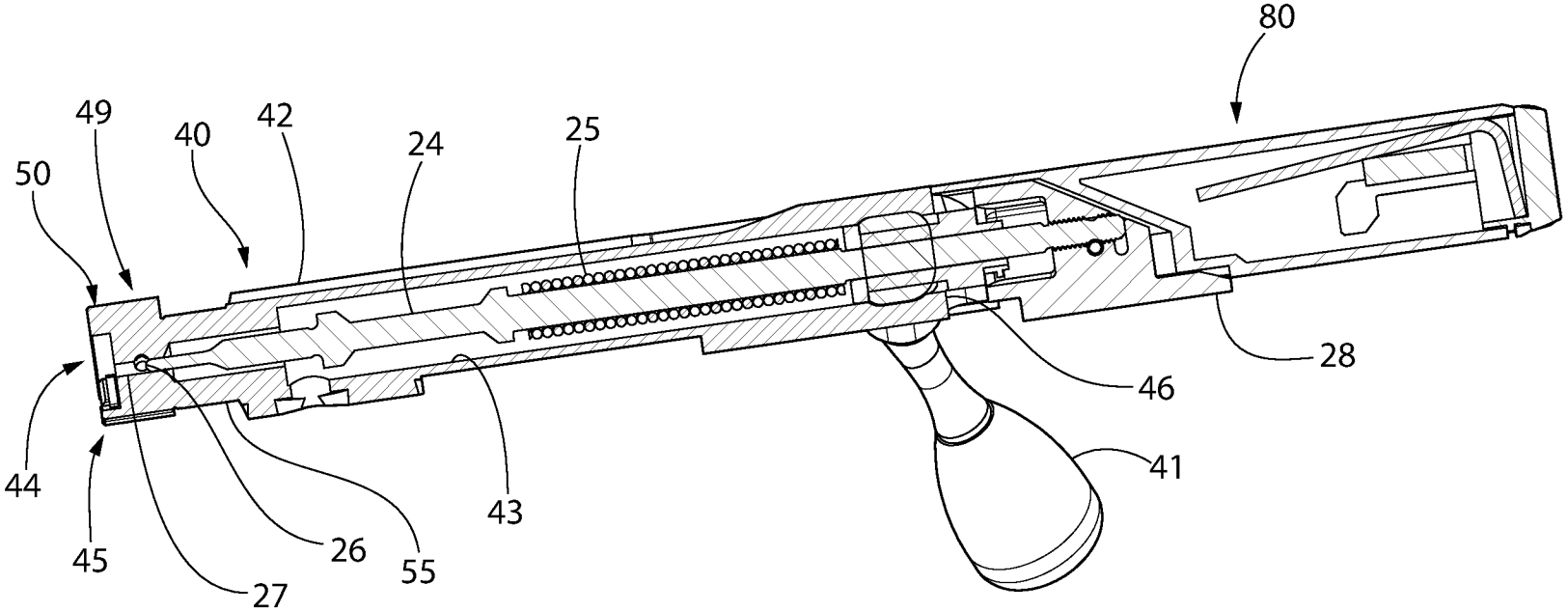
FIG. 11 is a longitudinal cross-sectional view thereof taken from FIG. 10.

Channel 43 of the bolt 40 holds the firing pin 24 and firing pin spring 25 (see cross-section FIG. 11). The narrowed front tip 26 of the firing pin is projectable through a complementary configured axial through-hole 27 formed in the recessed vertical front breech face 44 of the bolt head 49 for striking a chambered cartridge C when the bolt and breech are closed. Also disposed at the breech face 44 is a spring-loaded ejector 47 in the form of a plunger or pin and a spring-loaded extractor 48 configured to engage the rear rim of a chambered cartridge C for extracting the cartridge from the chamber 83 after firing.

Bolt head 49 includes a plurality of radial bolt lugs 50 projecting outwards from the head. Bolt lugs 50 are configured and arranged to complement and engage the breech locking lugs 84. In one embodiment, three bolt lugs 50 may preferably be provided (as shown) to minimize the angular rotation of the bolt 40 required by a user to form the locked and unlocked breech positions when manually cycling the action. However, it will be appreciated that in other embodiments two bolt lugs may alternatively be provided instead using a bolt designed according to principles of the present invention.

Figure 21:
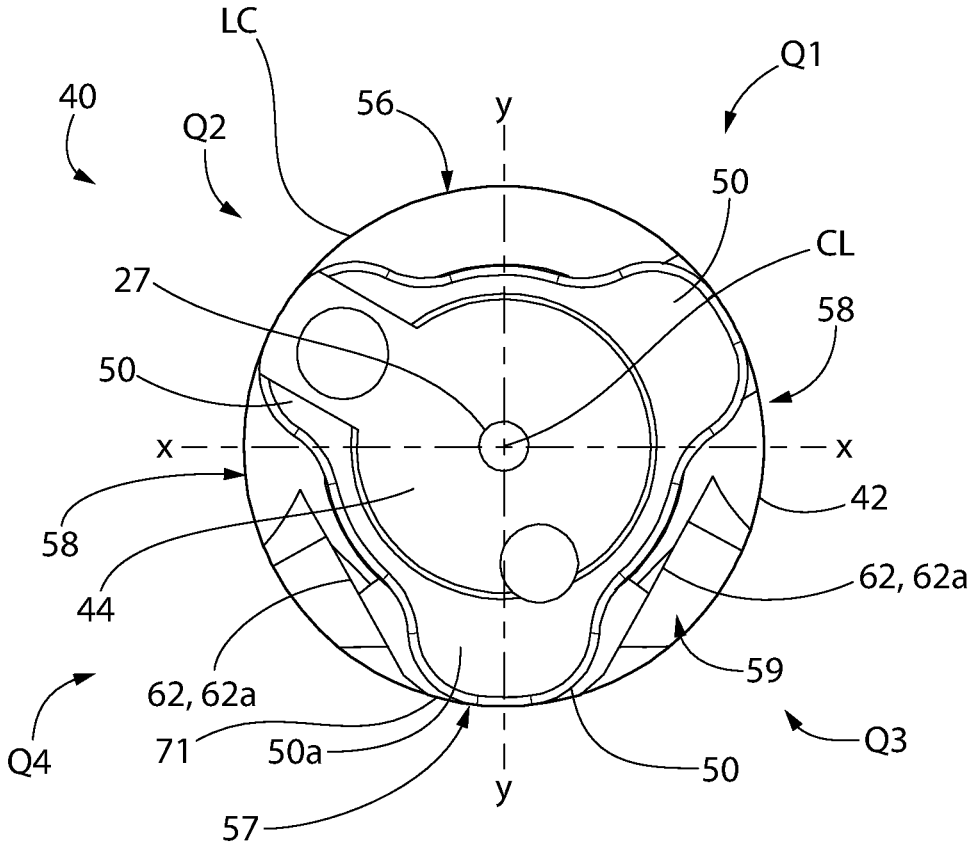
FIG. 21 is a front end view thereof.
Figure 22:
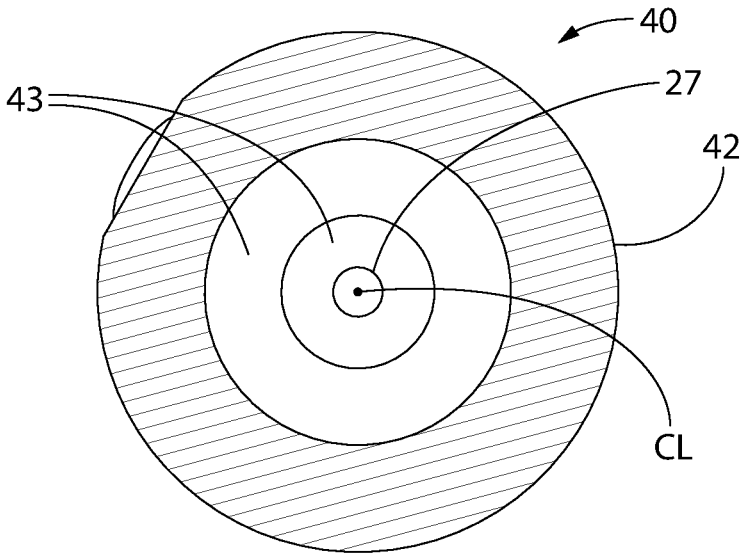
FIG. 22 is a transverse cross-sectional view thereof looking forward and taken along line XXII in FIG. 17.

The bolt lugs 50 may be spaced apart circumferentially from each other in an equidistant manner as best shown in FIG. 21, which is a front view of the bolt head 49 showing the bolt lugs rotated into the cartridge feeding orientation. Accordingly, the bolt lugs may be angularly spaced apart from each other at 120 degree intervals. One of the bolt lugs 50 may define a cartridge feed lug 50*a* which is positioned on the bolt head 49 for stripping cartridges C from magazine 30 between the magazine feed lips 33 for insertion into the barrel chamber when loading rifle 20. Feed lug 50*a* is positioned at the vertical bottom of the bolt head 49 when in the feeding position as shown when the bolt 40 is in the unlocked breech rotational position. Feed lug 50*a* has a lateral width less than the width W3 measured between the feed lips 33 (see, e.g. FIG. 29). Similarly, the lower portion of the front section 52 of the bolt body 42 which defines a downwardly extending operating projection 90 containing the leading bottom stub surface 71 (see also FIGS. 15 and 18) also has a width less than width W3 to allow the stub surface to pass between and below the tops 33*a* of the magazine lips. In one embodiment, the operating projection 90 on the lower half of the front section 52 of the bolt body 42 on which the stub surface 71 is formed may be generally V-shaped. Both the feed lug 50*a* and stub surface 71 operate to pass forward and rearward between and below the tops 33*a* of the feed lips 33 when the bolt is moved between the open and closed breech positions. In one embodiment, the terminal end of the feed lug 50*a* and the stub surface 71 formed on the bottom of operating projection 90 are spaced at an equal distance from the axial centerline CL of the bolt 40. This locates the end of the feed lug and stub surface at the same elevation with respect to the magazine feed lips 33 for stripping or pushing down the uppermost cartridge C in the magazine 30.

Figure 23:
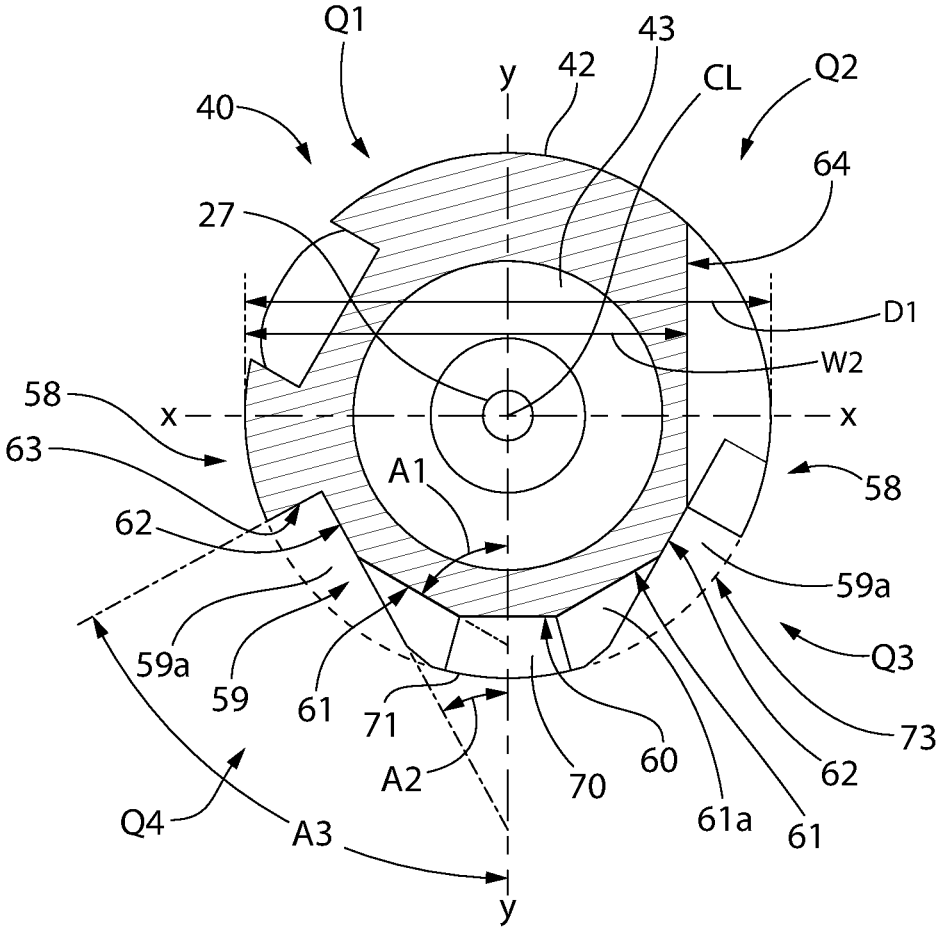
FIG. 23 is a transverse cross-sectional view thereof looking forward and taken along line XXIII in FIG. 17.
Figure 24:
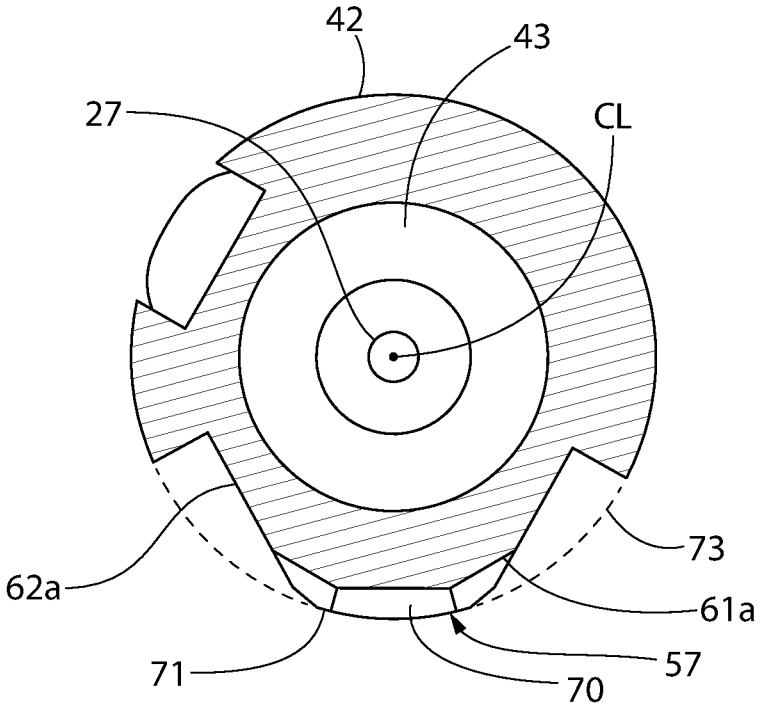
FIG. 24 is a transverse cross-sectional view thereof looking forward and taken along line XXIV in FIG. 17.
Figure 25:
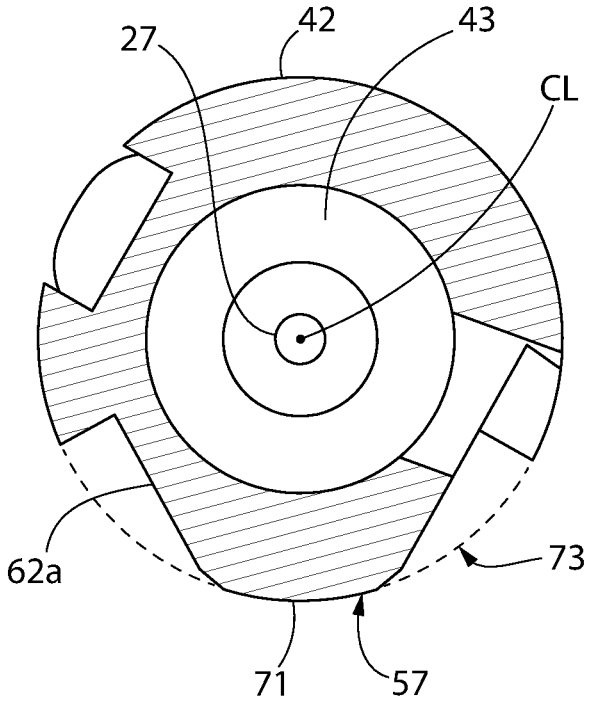
FIG. 25 is a transverse cross-sectional view thereof looking forward and taken along line XXV in FIG. 17.

For convenience as shown in FIGS. 21 and 23, an orthogonal X-Y axis reference system may be considered created by the bolt head 49 which defines an upper left quadrant Q1, upper right quadrant Q2, lower left quadrant Q3, and lower right quadrant Q4. The Y axis represents a vertical axis and the X axis a horizontal axis both of which intersect at the longitudinal centerline CL of the bolt body 42. Centerline CL is coaxial with longitudinal axis A-A. In the cartridge feeding position, feed lug 50*a* is positioned on the Y axis between lower left and right quadrants Q3, Q4 and one remaining lug 50 each is positioned in the upper left and right quadrants Q1, Q2. The upper quadrants Q1 and Q2 define the upper half of the bolt body 42 and the lower quadrants the lower half of the body.

In one embodiment, the bolt lugs 50 have terminal ends which collectively circumscribe a lug circle LC shown in FIG. 21 which coincides with the diameter D3 of the rear section 53 and D1 of the front section 52 of the bolt body 42 further described below. Accordingly, the bolt lugs 50 have a length which does not protrude substantially beyond the bolt body.

Figure 18:
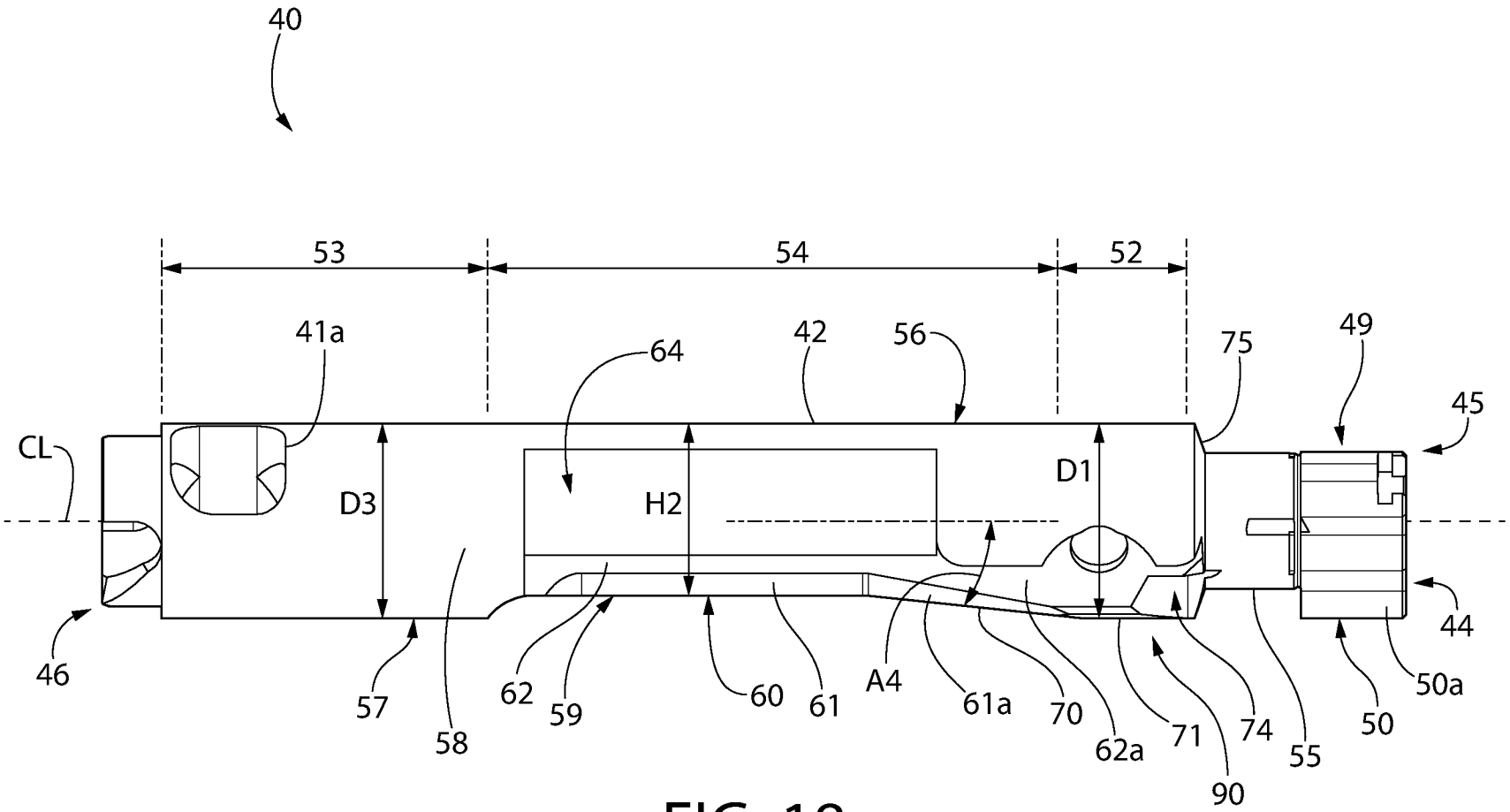
FIG. 18 is a right view thereof.
Figure 19:
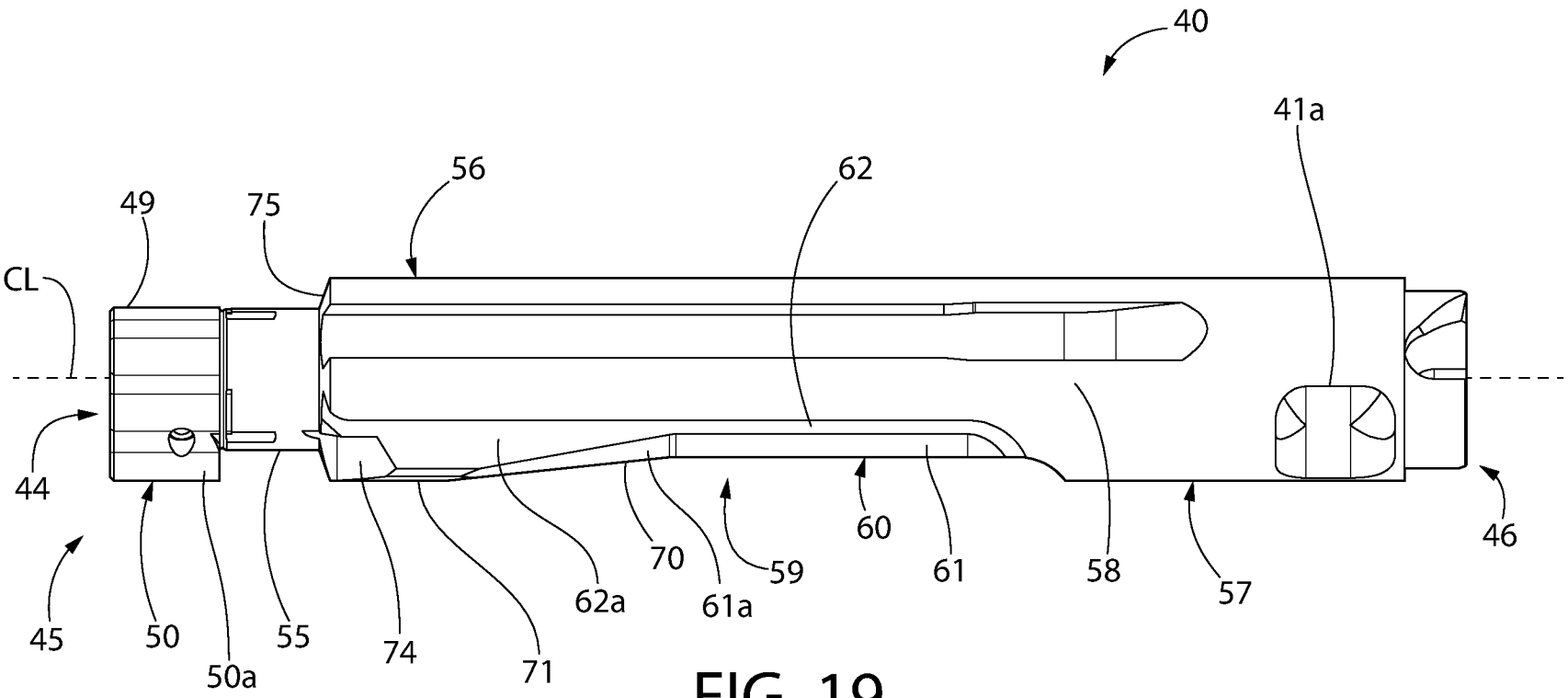
FIG. 19 is a left view thereof.
Figure 20:
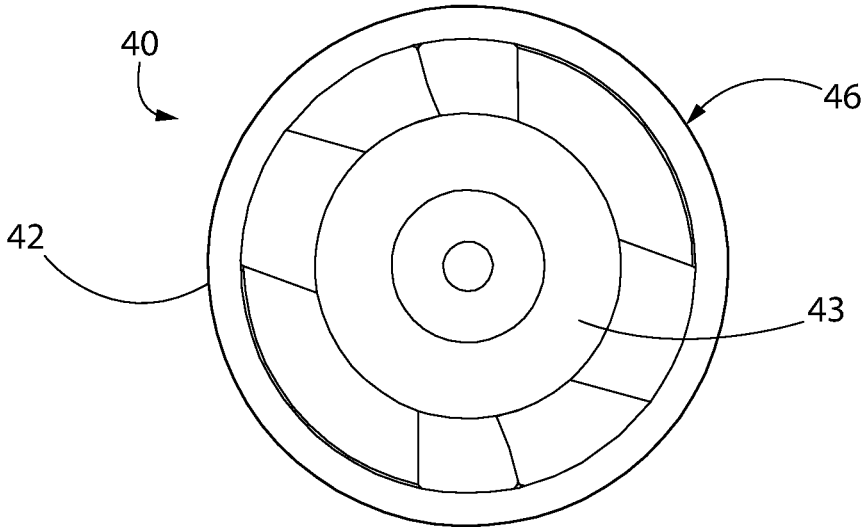
FIG. 20 is a rear end view thereof.

As shown in FIG. 18, the bolt body 42 includes front section 52, rear section 53, and a middle section 54 therebetween. Front section 52 has an outer diameter D1, rear section 53 has an outer diameter D3, and middle section 54 has a height H2 and lateral width W2 (FIG. 23). In one embodiment, middle section 54 is a dimensionally reduced section or portion of the bolt body 42 having a smaller height H2 and lateral width W2 (identified in FIG. 23) than diameter D1 of the front section 53, and in certain embodiments preferably also smaller in height and width than diameter D3 of rear section 53. Accordingly, the middle section has a smaller height H2 than the height of the front section 52 represented by diameter D1 measured vertically between the top and bottom of the bolt body. Similarly, the middle section has a smaller height H2 than the height of the rear section 53 represented by diameter D3 measured vertically between the top and bottom of the bolt body. The reduced middle section 54 is defined herein as beginning and ending between and where the full diameter front and rear sections 52, 53 terminate. A portion of the middle section 54 is positioned adjacent to the magazine feed lips 33 when the bolt 40 is in the forward closed breech position (see, e.g. FIG. 26). Middle section 54 is configured and dimensioned to prevent engagement with the bottom inner sliding surfaces inside the receiver cavity 22 when the bolt 40 is mounted therein. Only the front and rear sections 52, 53 slidably engage the receiver (i.e. surface 73 illustrated in dashed lines in FIGS. 23-25) and support the bolt in this non-limiting embodiment. In some implementations, the bolt head 49 may be connected to the main bolt body 42 by a diametrically smaller neck portion 55 having a diameter smaller than diameter D1 of front section 52 as illustrated. It bears noting that the foregoing diameters D1 and D3, and height H2 and width W2, are measured transversely to the longitudinal axis A-A.

It bears noting that the reduction in height H2 of the middle section 54 in comparison with the full height front and rear sections 52, 53 of the bolt body 42 is taken completely on the bottom of the middle section. This is where the reduction in material is desired to avoid interference with magazine feed lips 33 to permit rotation of the bolt 40 between the locked and unlocked breech positions when the bolt is closed (i.e. forward in battery with the barrel). Accordingly, it is unnecessary to reduce the height of the middle section at the top so that as seen in FIG. 18, the top surface of the middle section is flush with and maintains a constant curvature with the top surfaces of the front and rear sections 52, 53. For manually operated bolt action rifles, this is a especially desirable for at least aesthetic reasons because the top of the bolt in the middle section remains exposed and visible to users in the rifle design. For structural reasons, this is also preferable to maximize the strength and integrity of the bolt in the middle section despite a reduction in material at the bottom of the middle section.

The reduced diameter middle section 54 contains the longitudinal recess 59 and is configured to avoid interference with the magazine feed lips 33 of a double stack magazine (or single stack magazine) 30 (see, e.g. FIGS. 26-28) such that the bolt 40 may be fully rotated into the locked breech position when the bolt (i.e. action) is closed (i.e. closed breech position in battery with the barrel 81) as shown in FIGS. 1A, 1B, and 26-28. Accordingly, middle section 53 is axially aligned with and positioned over the cartridge feed lips 33 when the breech is closed. The longitudinal recess 59 in one embodiment does not extend beyond the middle section 54 of the bolt body 42 and terminates at the front and rear sections 52, 53. The laterally open portions 59*a* of the recess 59 formed in the left lateral sidewall surfaces 58 of the bolt body 42 comprise a majority of the surface area of the lower left quadrant Q4 in the middle section 54. By contrast, the laterally open portions 59*a* of the recess 59 formed in the right lateral sidewall surfaces 58 of the bolt body 42 comprise all of the surface area of the lower left quadrant Q4 and a portion of the upper right quadrant Q2 in the middle section 54. The larger and full diameter front section 52 and rear section 53 maintain optimal bolt strength and support for slidably engaging the inner bottom sliding surface 73 of the receiver 21. The middle section 54 of the bolt body does not engage the bottom sliding surface in one configuration.

Referring specifically to FIGS. 14, 15, 17, 21, and 23, the middle section 54 of bolt 40 includes a plurality of specially chamfered or angled surfaces which allow the bolt to rotate a sufficient angular distance to lock the breech when the middle section is longitudinally aligned over the cartridge feed lips 33. Beginning at the bottom of the bolt 40, the middle section 54 includes a first planar bottom surface 60, two planar second lower angled side surfaces 61 (one each side), two planar upper third angled side surfaces 62 (one each side), a fourth planar angled side surface 63 on the left lateral sidewall surface 58 of the bolt body 42, and a fifth planar angled side surface 64 on the right lateral sidewall surface 58 of the bolt body. The surfaces 60-64 are circumferentially contiguous for an angular extent and collectively form a multi-faceted recess 59 and transverse cross-section in the middle section 54, as best shown in FIG. 23. This special configuration avoids interference with the cartridge feed lips 33, while advantageously retaining as much material as possible in the thinner middle section 54 to maintain the structural integrity of the bolt between the ends. Also importantly, the provision of the multiple angled surfaces 61-64 maintains a relatively consistent and sufficient thickness of bolt material surrounding the internal firing pin channel 43 for strength (see, e.g. transverse cross-section of FIG. 23 looking forward and transverse cross-sections of FIGS. 27-28 looking rearward). In contrast to the planar faceted surfaces described above, the top 56 of the middle section 54 may be arcuately rounded or curved (see, e.g. FIGS. 18, 19, and 23).

With continuing reference to FIGS. 14, 15, 17, 21, and primarily FIG. 23, the bottom surface 60 may be horizontally oriented (i.e. parallel to the lateral horizontal X-axis and perpendicular to the vertical Y-axis of the bolt body which intersect orthogonally at the axial centerline CL of the bolt which is coaxial with longitudinal axis A-A). The second lower angled surfaces 61 may a planar and oriented at an oblique angle A1 with respect to the Y-axis. In some implementations, angle A1 may be from about and including 40-80 degrees, for example without limitation about 60 degrees. The third angled surfaces 62 may a planar and oriented at an oblique angle A2 with respect to the Y-axis. In some implementations, angle A2 may be from about and including 10-50 degrees, for example without limitation about 30 degrees. Accordingly, in some embodiments, angle A1 may be greater than angle A2. The fourth angled side surface 63 on the left side of the bolt middle section 54 may a planar and oriented at an oblique angle A3 with respect to the Y-axis. In some implementations, angle A3 may be from about and including 40-80 degrees, for example without limitation about 60 degrees. In one embodiment, angled side surface 63 may be orientated such that a straight radial line drawn across the surface intersects the longitudinal centerline CL of the bolt body 42. Angled surfaces 61, 62, and 63 may each be obliquely angled and oriented with respect to each other such that angles A1-A3 are each different. In other possible satisfactory but less preferred embodiments contemplated, angled surfaces 62 on each side of the middle section 54 may be omitted and angles surfaces 61 may instead each extend upwards from the lateral sides of the bottom surface 60 and directly intersect the angled surfaces 63 and 64. The additional of the angled surfaces 62 however maximizes the bolt's structural strength in the middle section by resulting in transverse cross section which reduces less material.

The fifth angled side surface 64 on the right side of the bolt middle section 54 may be planar and oriented substantially parallel to the vertical axis Y of the bolt. This forms a flat lateral side of the bolt body 42 in the middle section 54. The side surface 64 extends vertically through portions of both the lower right quadrant Q3 and upper right quadrant Q1 (best shown in FIG. 23) above and below the bolt longitudinal centerline CL, and may be larger in surface area than surfaces 61, 62, and 63. This creates an asymmetrical transverse cross-sectional shape of the middle section 54 because the side of the bolt 40 on which the bolt handle 41 is located requires a greater reduction in bolt material to provide more rotational clearance to avoid the magazine feed lips 33 for locking and unlocking the bolt when in a closed position in battery with the barrel 81 (see also FIGS. 27 and 28 which are cross-sectional views looking rearward). In some embodiments, angled side surface 64 may be formed in the bottom of a laterally open recess cut or otherwise formed in the right side of the middle section 54 of the bolt body 42 (see, e.g. bottom plan view of FIG. 17). In the present embodiment, a right side or handed bolt is shown herein. In other embodiments, the angled surfaces 61-64 would be reversed such that a greater reduction in bolt material is provided on the left side of the bolt instead of the right side as illustrated herein in the event a left side or handed bolt handle 41 is alternatively provided instead (e.g. the larger side surface 64 would be on the left and smaller side surface 63 would be on the right of the bolt). Accordingly, in such alternative embodiments, the geometry of the middle section 54 may essentially be reversed from that shown herein for left hand operated bolts having the bolt handle 41 on the left side.

Figure 31:
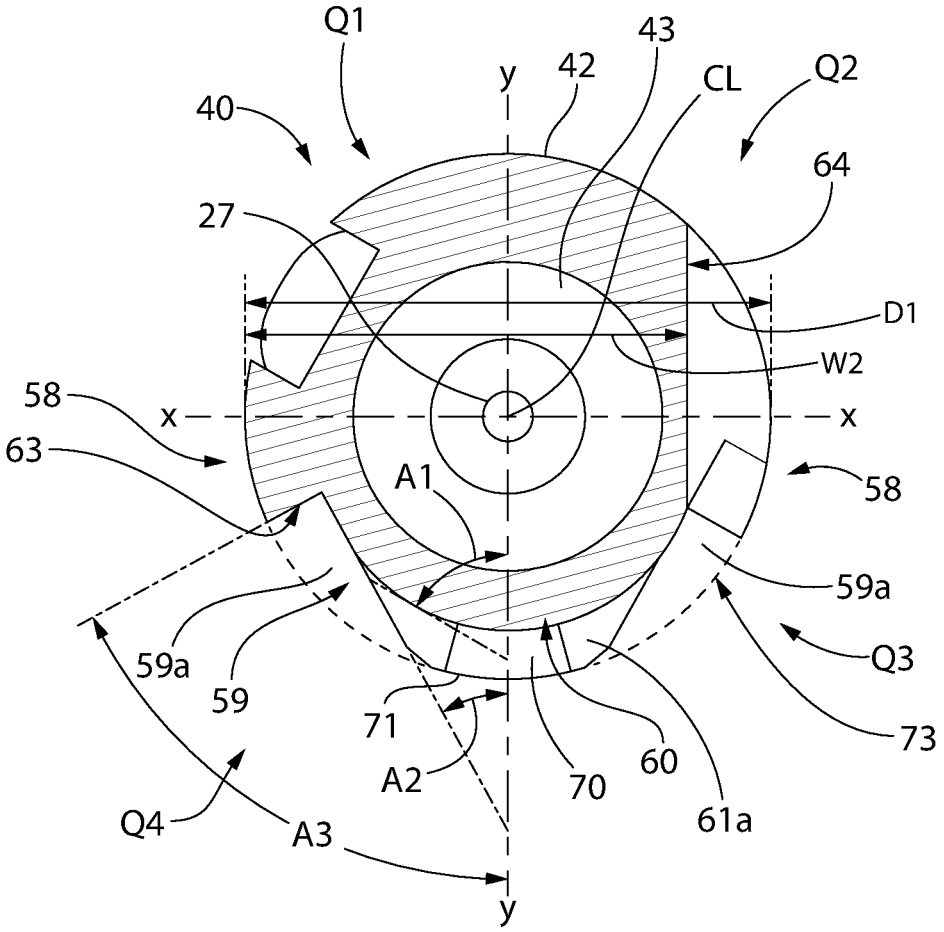
FIG. 31 is a transverse cross-sectional view of an alternative embodiment of the bolt body with middle section having a rounded contour in lieu of the angled surfaces shown in FIG. 23.

It will be appreciated that other angular variations and configurations are possible and may be used beyond those described herein within the scope and spirit of the invention. For example, in certain implementations some or all of the angled edges formed between adjoining angled surfaces 60-64 may be rounded to provide a smooth transition from one planar surface to the next. The rounded edges may be such that an arcuately curved convex transverse cross sectional profile having a constant curvature is formed in the middle section between surfaces 60-64, with surface 64 remaining flat in transverse cross section as shown in FIG. 31 of an alternative bolt construction. In addition, other possible embodiments of bolt 40 may include one or more arcuately curved surfaces, convex or concave, which could be combined in a similar manner to that taught herein for planar surfaces 60-64 in order to create a similar geometry and height/width reduction in middle section 54 but with no or fewer number of flat or planar surfaces. Accordingly, various implementations are possible to reduce the cross sectional area of the middle section 54 of the bolt body 42 to provide clearance between the bolt and the magazine feed lips 33 when the bolt is in the closed breech position to allow the bolt to be rotated for locking and unlocking the breech via the firearm's locking lugs and bolt lugs.

Because the lower feed lug 50*a* is still at full diameter in the present embodiment, and the middle section 54 of the bolt body 42 has been dimensionally reduced in transverse cross section (e.g. height and width) to allow rotation of the bolt 40 when closed, the rear surface of the lug 50*a* would contact the next cartridge when the bolt is withdrawn from the barrel and opened causing the lug to either catch on it, damage it, or make working the bolt difficult due to the increased resistance created. The double stack 20 and 30 round magazines available for AR-15 type rifles will generate a significant upward spring force, especially when fully loaded. In addition, the rear of the bolt feed lugs 50 (including feed lug 50*a*) generally must be kept sharp, and at full diameter, to maintain bolt strength when forming a locked breech. Therefore, feed lug 50*a* preferably should be protected and not be allowed to contact the cartridges when pulled rearward in the receiver 21 by the user.

To accomplish the aforementioned objective, both an axially oriented stub surface 71 and a low angled cartridge ramp 70 are formed on the bottom surface 60 of the bolt body 42 in the middle section 54 and positioned behind the lower feed lug 50*a*. The ramp 70 advantageously minimizes the force required to pull the bolt backwards through the magazine and move the cartridges down below the bolt lug to avoid contact when the bolt is retracted rearwards. This can be best seen in FIGS. 14, 15, 17-19, 23, and 24. Angled cartridge ramp 70 may be disposed at an oblique angle A4 to the longitudinal centerline CL of the bolt 40 (see FIG. 18). In some implementations, angle A4 may be from about and including 2-20 degrees, for example without limitation about 6 degrees. Ramp 70 slopes in a downward direction from the rear to front of the bolt 40. The ramp 70 may have a planar surface in some embodiments and is further oriented at an oblique angle to bottom surface 60 of the middle section 54 of the bolt body 42, which by contrast is substantially parallel to bolt centerline CL.

Ramp 70 forms an angled transition between the reduced diameter middle section 54 of the bolt body and the front full diameter section 52. A transversely arcuate convex portion of the bolt longitudinal bottom surface 57 in the front section 52 of bolt body 42 forms the leading bottom stub surface 71 forward of the ramp 70 between the ramp and the neck portion 55 and feed lug 50*a* (see, e.g. FIGS. 14-19 and 23-26) A transverse cross-section taken at the stub surface 71 of the front section 52 therefore has a full diameter D1 such that the front section 54 and stub surface 71 forming a part thereof can slidably engage the inner bottom sliding surface 73 of the receiver 21 (represented by dashed lines in FIG. 23-25) for full support of the bolt to provide smooth operation. In one embodiment, diameter D1 of the front section 52 which includes stub surface 71 may have the same diameter D3 as the rear section 53 (see, e.g. FIG. 18).

The second lower angled surfaces 61 extend forward from middle section 54 of the bolt body 42 to form contiguous opposing obliquely angled lateral sides 61*a* of the ramp 70 (see, e.g. FIGS. 14, 15, 17, and 23). Lateral sides 61*a* may be wedge shaped in one embodiment. Portions of the third angled surfaces 62 extend forward from middle section 54 to form contiguous opposing obliquely angled lateral sides 62*a* of the stub surface 71 (see, e.g. FIGS. 14, 15, 17, and 24-25). Lateral sides 62*a* have a greater height than angled surfaces 62 in the middle section 54.

Figure 28:
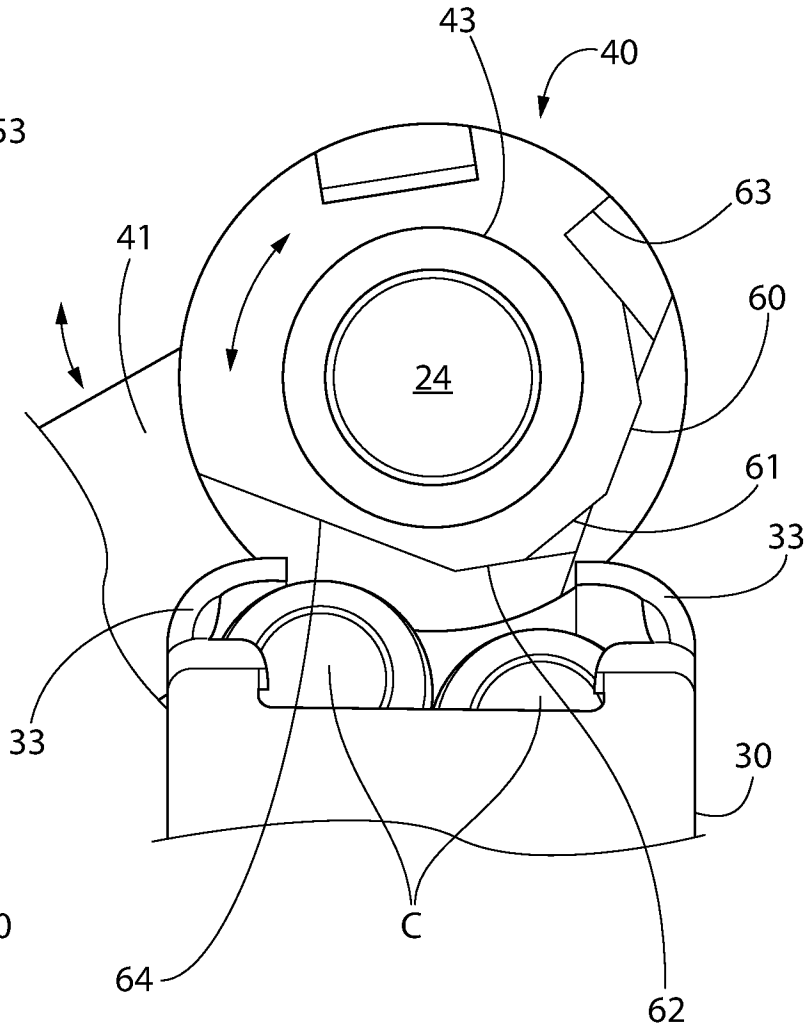
FIG. 28 is a transverse cross-sectional view of the bolt body thereof looking rearward with the bolt in a closed, fully locked breech position with the handle completely rotated downwards.
Figure 29:
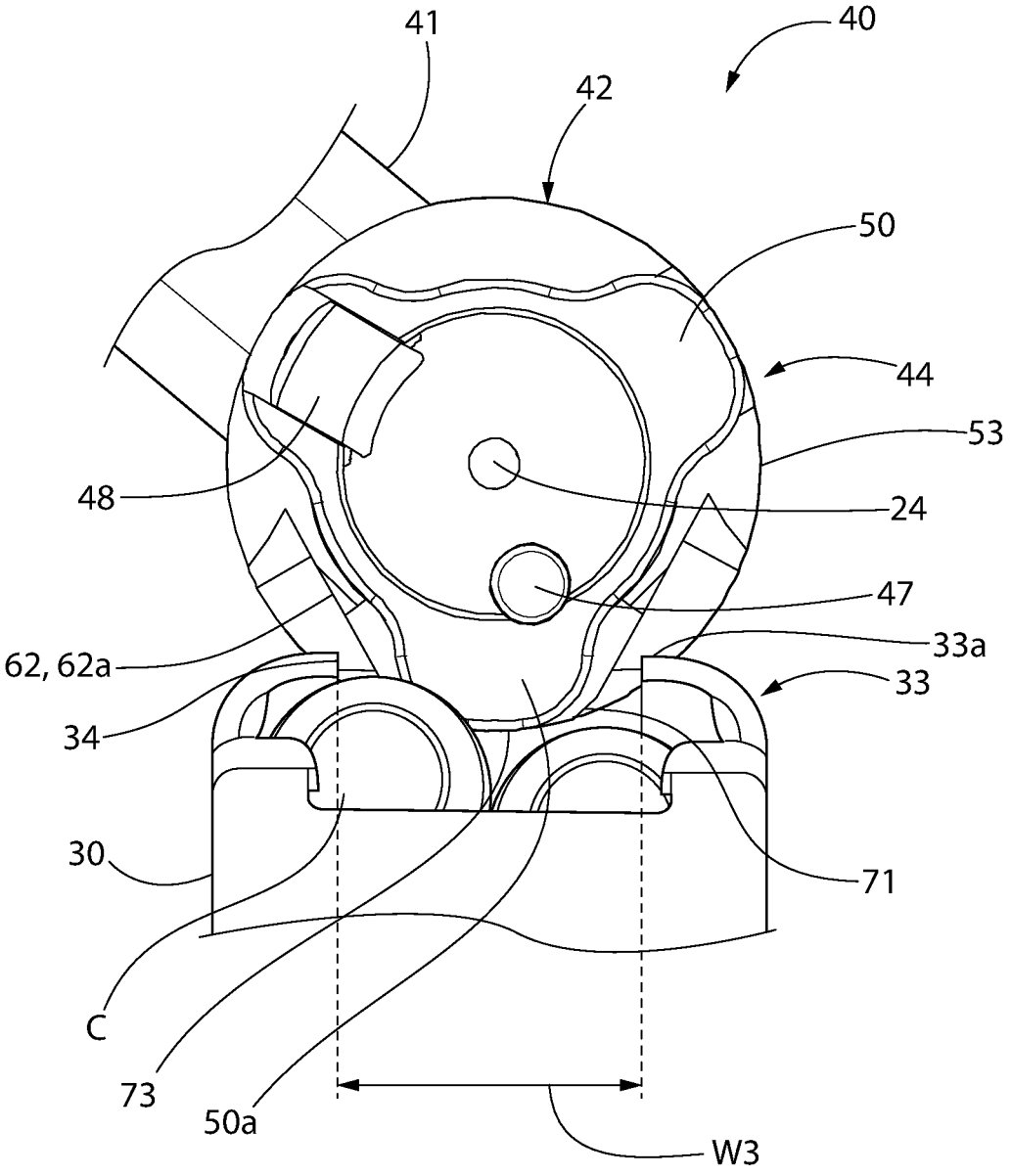
FIG. 29 is a front end view thereof looking rearward with the bolt in a fully unlocked rotational position representing a cartridge feed position with the handle completely rotated upward for movement of the bolt forward or rearward through the pair of magazine feed lips.

FIG. 29 shows a front view of the bolt body 42 and feed lug 50*a*, with the ramp 70 and bottom surface 60 of the front section 52 of the body protecting the feed lug from cartridge contact when the bolt is retracted rearward and opened. It bears noting that in the non-limiting illustrated embodiment, the rear section 53 of the bolt body 42 (to the rear of the side vertical angled surface 64) and the front stub surface 71 of the front section are both vertically positioned below a top 33*a* of each of the feed lips 33 (see also FIGS. 1A, 1C, and 27-28).

Figure 14:
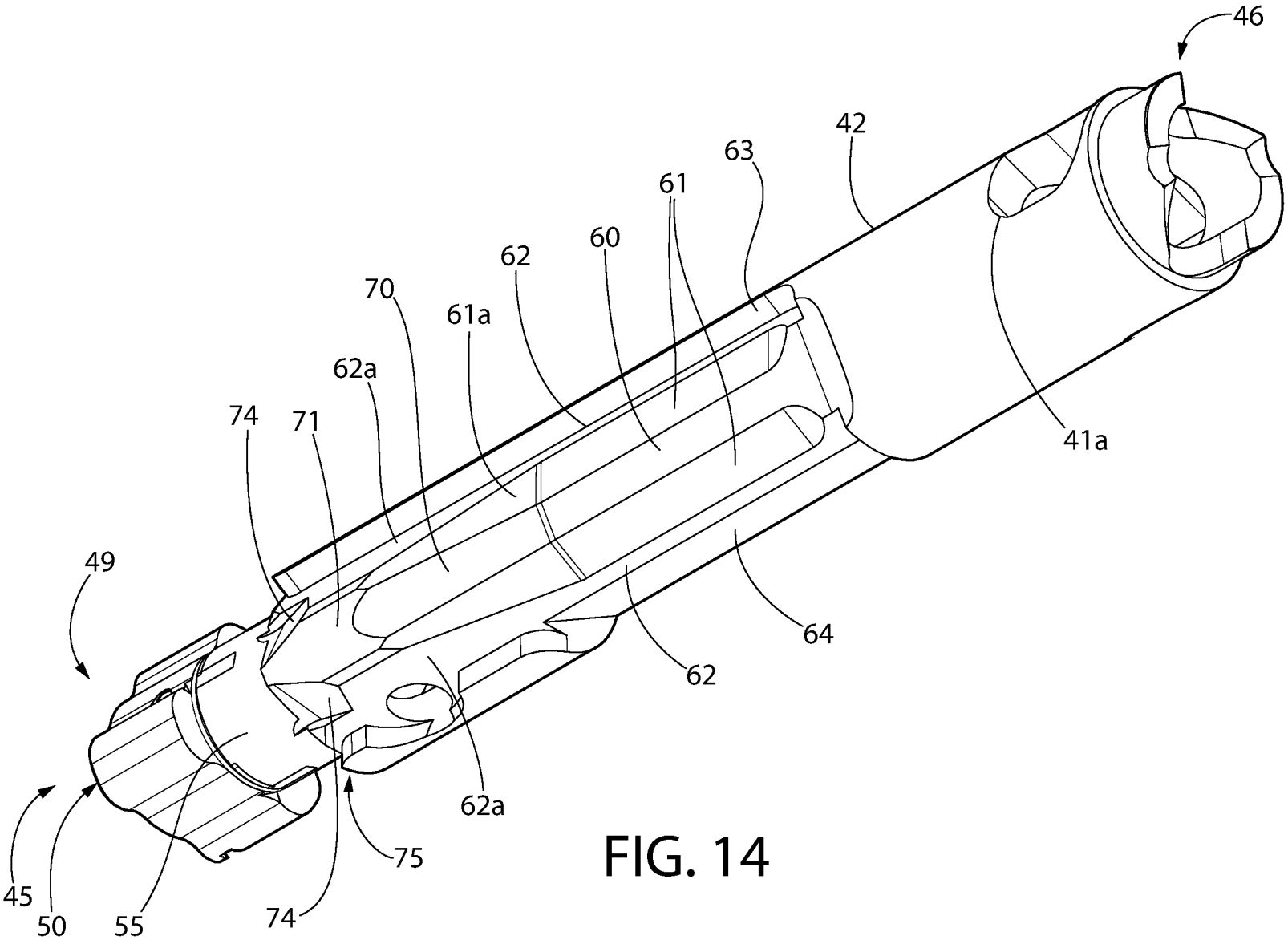
FIG. 14 is a bottom perspective view thereof.
Figure 15A:
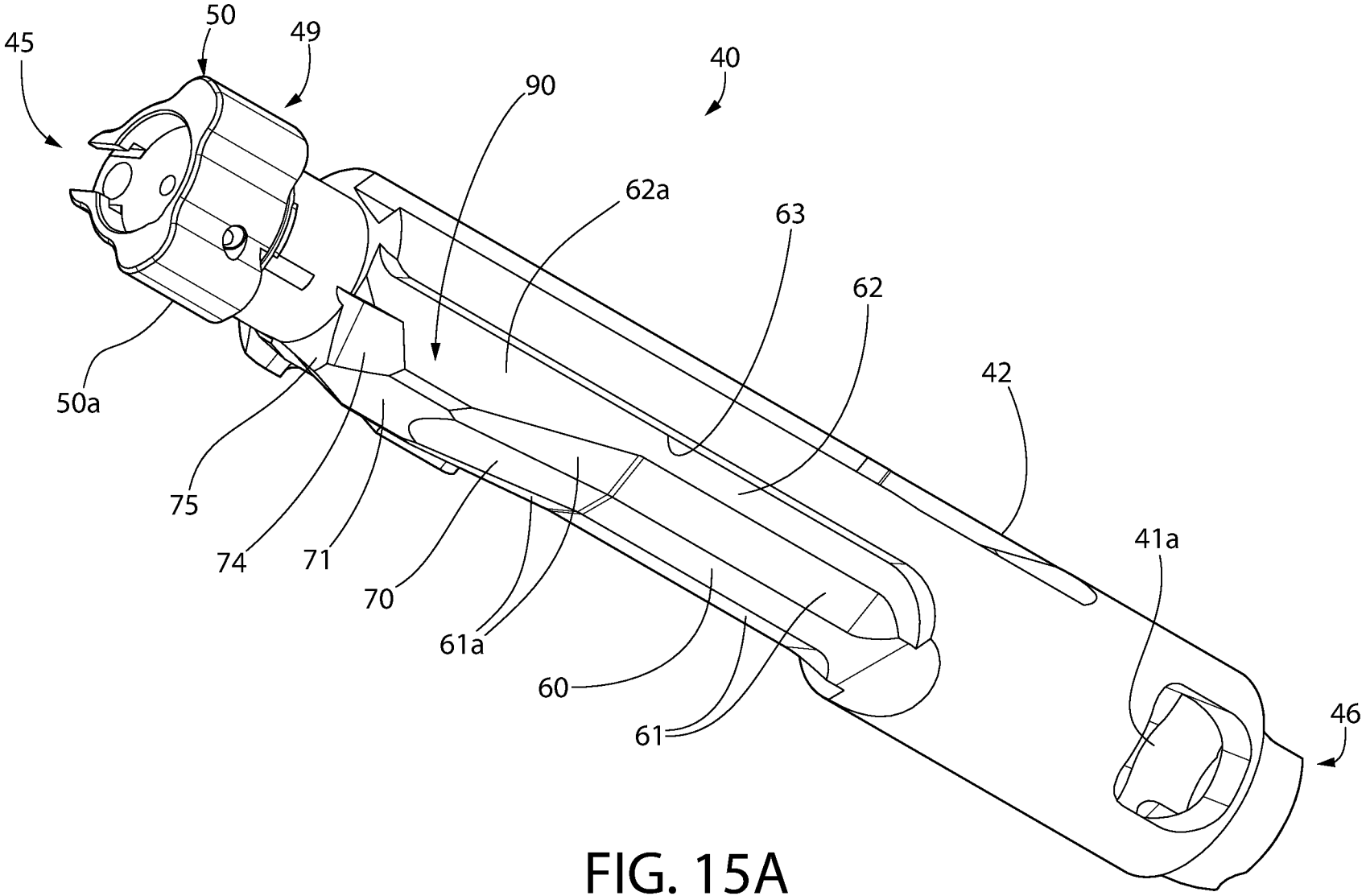
FIG. 15A is a second bottom perspective view thereof from the left side.
Figure 15B:
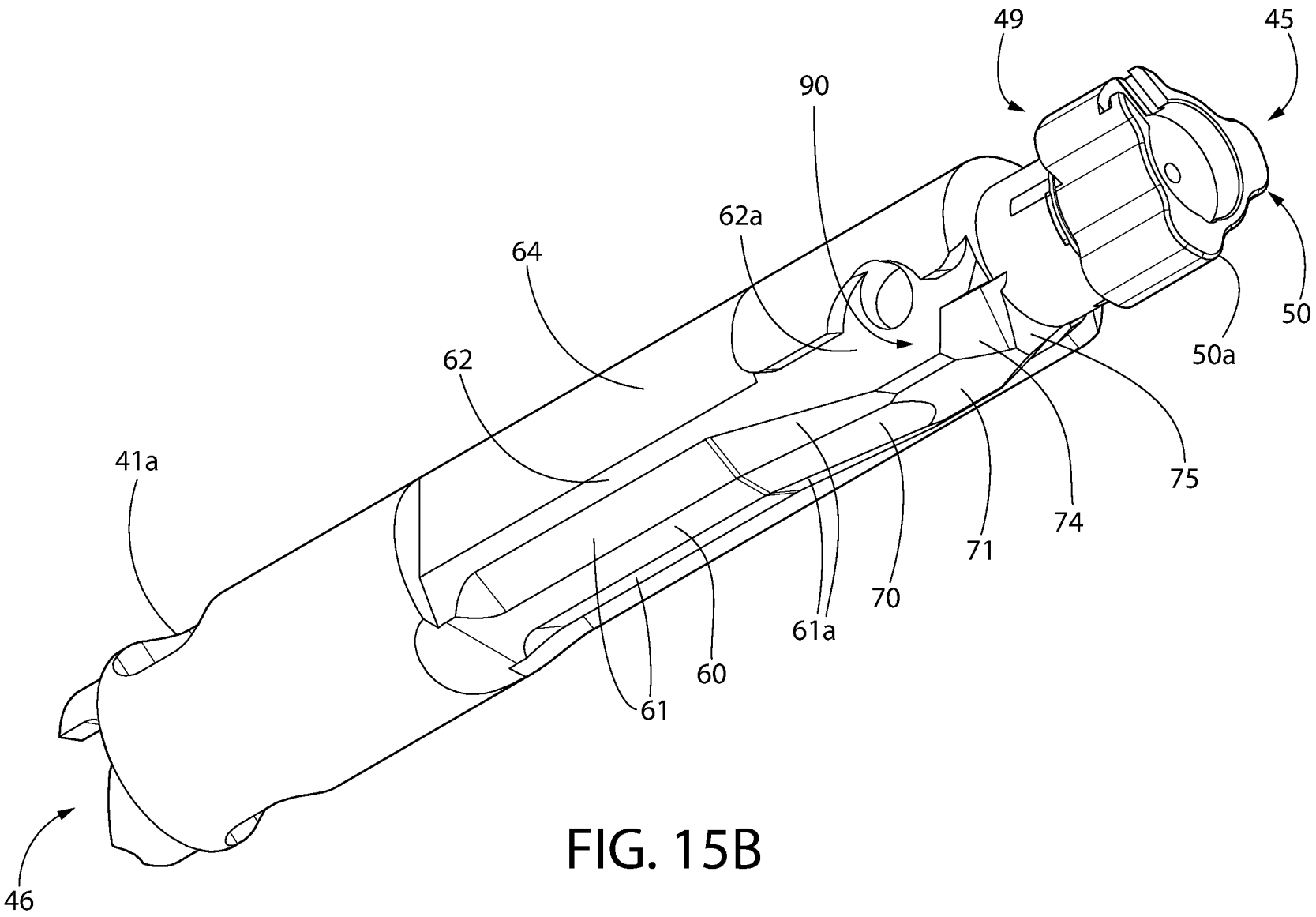
FIG. 15B is third bottom perspective view thereof from the right side.
Figure 16:
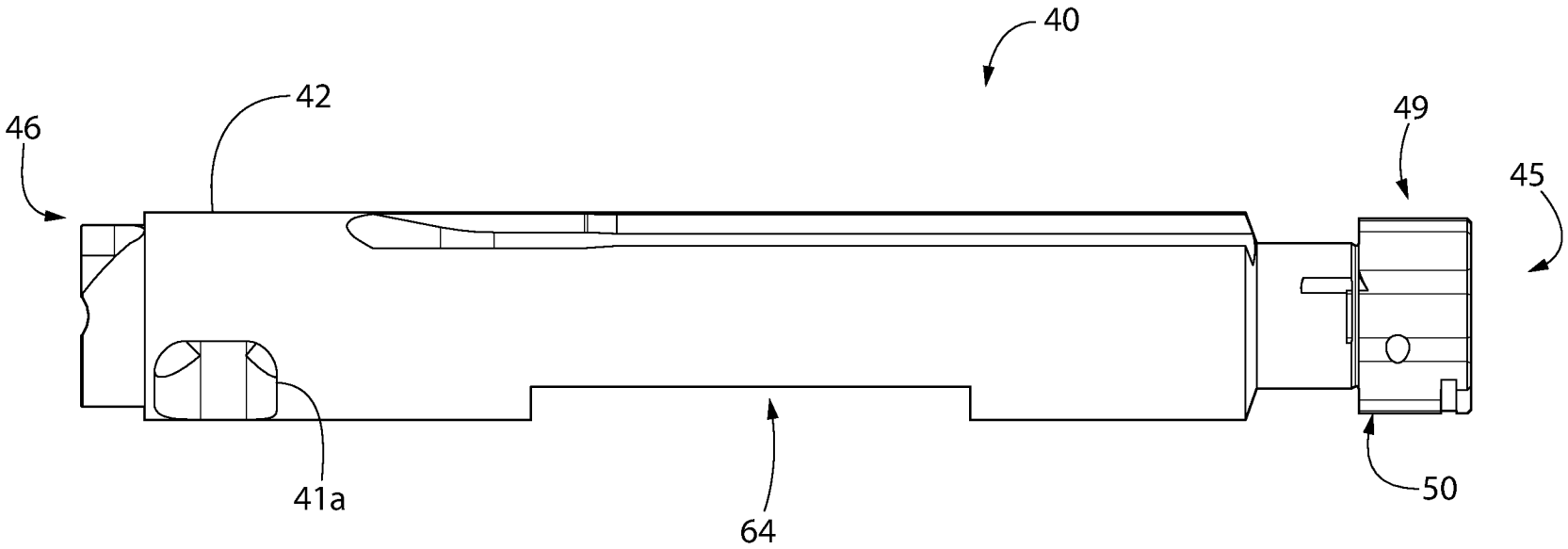
FIG. 16 is a top view thereof.
Figure 17:
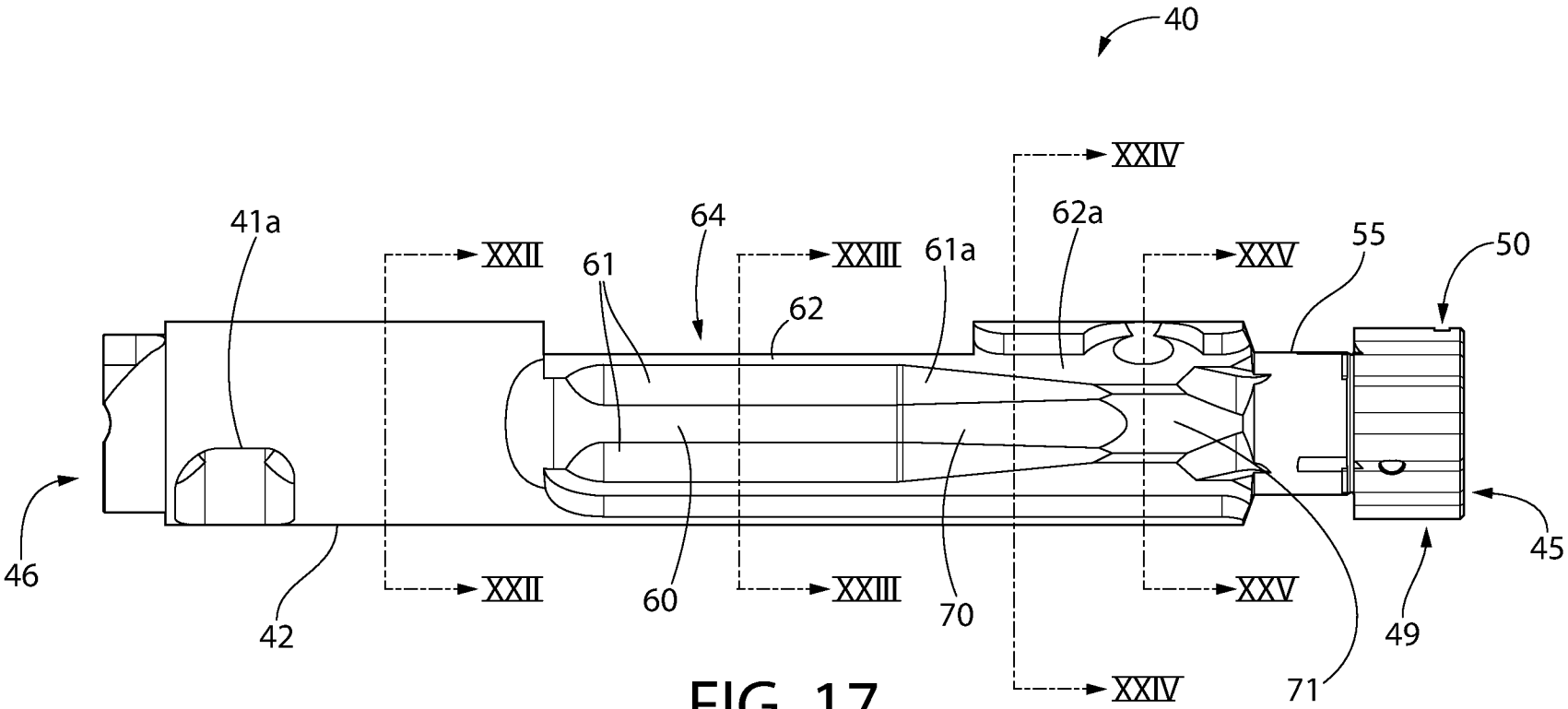
FIG. 17 is a bottom view thereof.

As shown in FIGS. 14, 15, and 18, the front shoulder 75 of the bolt body 42 (at transition between smaller diameter neck portion 55 and larger diameter body) may include an obliquely angled chamfered surface 74 adjoining each side of the bolt bottom stub surface 71 behind the shoulder. This creates a truncated triangular shape at the leading edge portion of the stub surface 71 to ensures smooth insertion of the bolt body through the magazine feed lips 33 and prevents unwanted contact with lower cartridges in the magazine.

Figure 26:
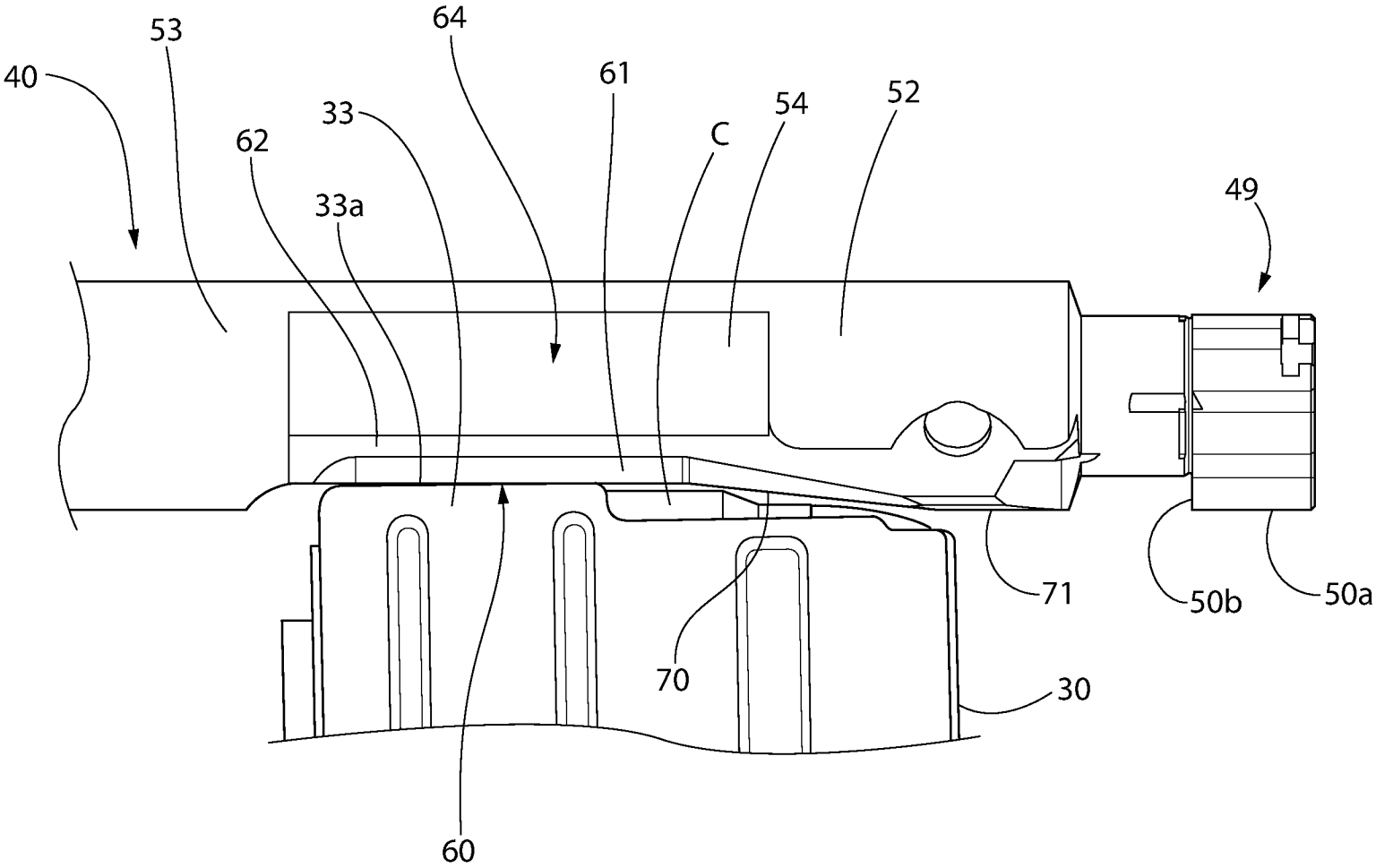
FIG. 26 is a right side view of the bolt body in the closed breech position located over the ammunition magazine and rotated into an open unlocked breech position.
Figure 27:
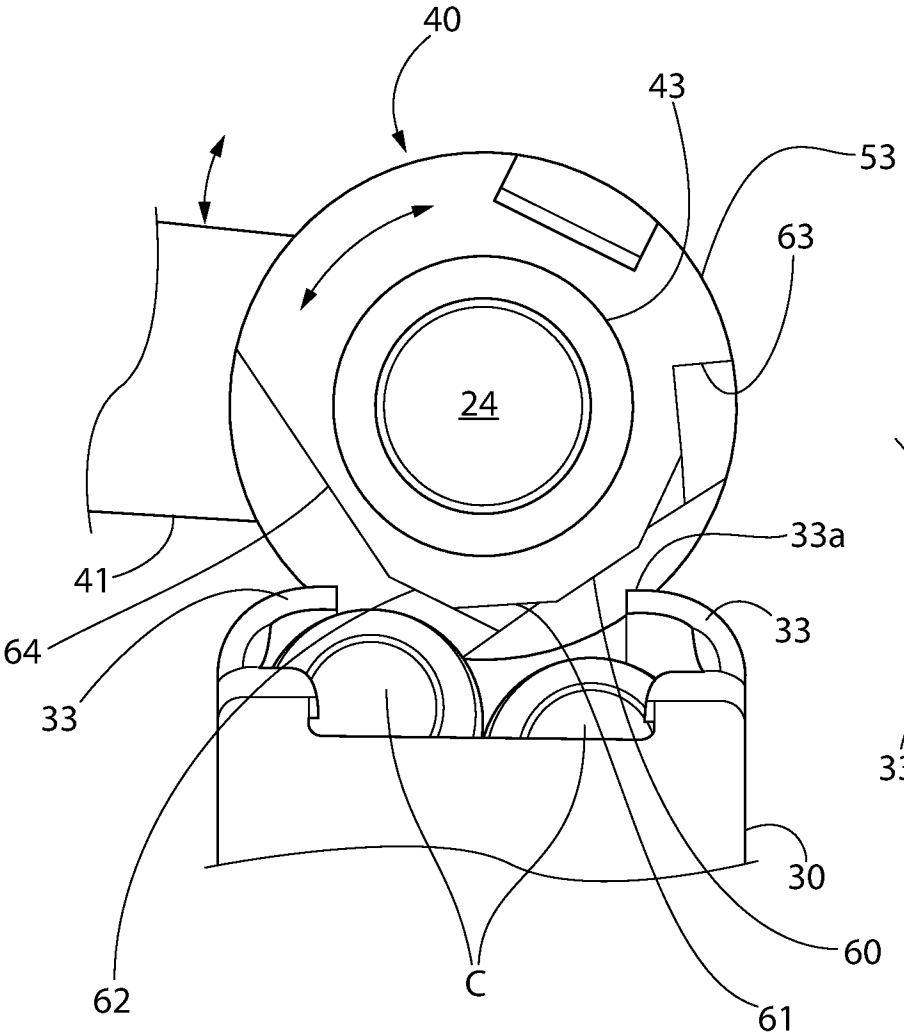
FIG. 27 is a transverse cross-sectional view of the bolt body thereof looking rearward with the bolt in a closed, partial locked breech position with handle partially rotated downwards.

Operation of the bolt 40 will now be briefly described primarily with reference to FIGS. 27 and 28 (cross-section views of bolt middle section 54 looking rearward) and FIG. 29 (front view of bolt looking rearward). It will be assumed that the bolt 40 is initially in a fully forward and closed breech axial position. Rotationally, the bolt is further assumed to be in the locked breech position (see, e.g. FIG. 28) wherein the bolt lugs 50 are engaged with the breech locking lugs 84. The bolt handle 41 is in a downward position as shown. The reduced diameter middle section 54 of the bolt is positioned directly over the magazine 30 and feed lips 33 as shown in FIG. 26. The spring-biased top cartridge C in the magazine 30 is engaged with the feed lips 33. In some configurations the top cartridge will be held below the feed lips by the bolt body.

To unlock the breech, the bolt handle 41 is lifted upwards to rotate the bolt 40 into the unlocked breech position (see, e.g. sequentially FIGS. 27 and 29). The bolt lugs 50 disengage the breech locking lugs 84. This moves the feed lug 50*a* into the downward 6 o'clock cartridge loading position as shown in FIG. 29. The angled ramp 70 and stub surface 71 are concomitantly positioned at 6 o'clock. The bolt is next drawn and retracted rearward to the open breech position. This causes the ramp 70 to engage and slightly push down the spring-biased stack of cartridges C temporarily as the inclined shoulders of the top cartridge contacts and slides downwards along the ramp. The top cartridge may disengage the feed lips 33 as it is displaced and held downward by successively the ramp, then bottom stub surface 71 of the bolt, and finally bottom of the feed lug 50*a* as the bolt moves rearward. It bears noting that the stub surface 71 holds the cartridges C down while the feed lug 50*a* becomes positioned over the top of the cartridges until the stub surface eventually disengages the cartridge. Advantageously, this ensures that the flat rear surface 50*b* of the feed lug 50*a* does not contact the cartridges when the bolt slides rearward which may either damage the feed lug or jam the action (see also FIG. 26).

Once the bolt 40 fully clears the magazine 30, the top cartridge rises again against the feed lips 33 and assumes an upward feed position for being stripped off by the bolt 40. The feed lug 50*a* is still oriented in the bottom cartridge loading position (6 o'clock) as shown in FIG. 29 and the handle 41 remains in the upright position. The bolt is then advanced forward to the closed breech position causing the feed lug 50*a* to engage the rear of the top cartridge. The feed lug 50*a* strips and pushes the top cartridge fully forward through and between the magazine feed lips into the barrel chamber 83, thereby chambering the round. The breech remains unlocked at this time.

To lock the breech, the bolt handle 41 is pushed downward which rotates the bolt 40 from the unlocked breech position into the locked breech position as shown sequentially in FIGS. 27 and 28. The bolt is now in the locked breech position of FIG. 28 wherein the bolt lugs 50 are engaged with the breech locking lugs 84. The rifle 20 is in the ready-to-fire condition with a closed and locked breech. It bears noting that angled surfaces 60-64 of the middle section 54 of the bolt body 42, and particularly the largest surface 64 on the side of the bolt that the bolt handle 41 is mounted, advantageously provides the clearance necessary to avoid interference between the bolt with the magazine feed lips 33. This allows the bolt to rotate between the locked and unlocked breech positions when the bolt is in the forward closed breech position (see also FIG. 26).

Figure 30:
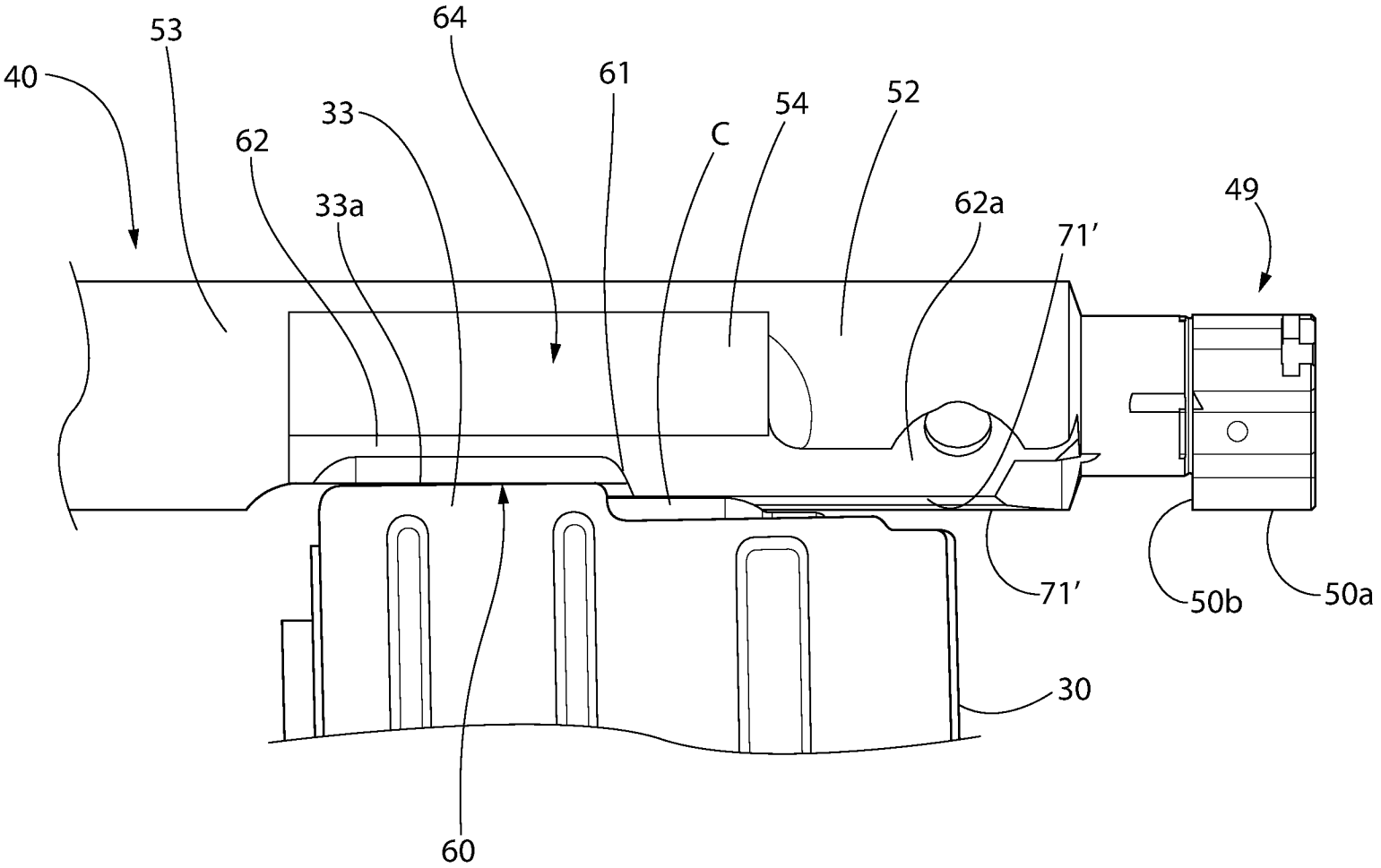
FIG. 30 is a right side view of an alternative embodiment of bolt body in the closed breech position located over the ammunition magazine and rotated into an open unlocked breech position.

FIG. 30 depicts an alternative embodiment of a bolt 40 without a cartridge ramp 70. The bolt is shown in the forward closed breech position. To accomplish the same functionality described above and avoid the rear surface 50*b* of the bolt feed lug 50*a* from striking the cartridge C when the bolt is retracted, the bottom stub surface 71' has a greater longitudinally extended axial length than the stub surface 71 shown in FIG. 26. The rear portion of the stub surface 71' occupies the same area on the bottom of the bolt as and supplants the ramp 70. Stub surface 71' engages and pushes the cartridges downwards in the magazine 30 until the feed lug 50*a* is positioned over the top of the uppermost cartridge casing when the action is cycled. Accordingly, the length of the stub surface 71' is selected to ensure that it does not break contact with the uppermost cartridge until the feed lug 50*a* is above the main cylindrical portion of the cartridge casing preferably behind the inclined frustoconical shoulder between the cylindrical portion and bullet/slug. The cartridges then engage the bottom, not the rear surface 50*b* of feed lug 50*a*. From that point, the feed lug may smoothly slide rearward along the cartridge casing of the uppermost cartridge as the bolt is further retracted.

In the bolt embodiment shown in FIG. 30, the stub surface 71' extends into a portion of the middle section 54 of the bolt body 42. The stub surface 71' maintains contact with the casing of the uppermost cartridge C in the magazine when the bolt is closed and pushes the cartridge stack downwards. In contrast to FIG. 26 where the horizontal stub surface 71 terminates at a point and is positioned forward of the cartridge casing (and preferably the bullet/slug attached to the front end of the casing), the greater elongated axial length of stub surface 71' in FIG. 30 does not require a ramp 70 to facilitate pulling the bolt rearward because the longer stub surface is not located forward of the cartridge casing. Stub surface 71' always maintains engagement with the cartridge casing when the bolt is closed. Note that when the bolt 40 is rotated to the locked breech position, the cartridge may rise up slightly as it rides along the side 62*a* of feature 71. When the bolt is again rotated back to the unlocked breech position seen in FIG. 30, the bottom stub surface 71' will again engage the top of the cartridge casing and the cartridge will be pressed back down into the position shown, with a rotating cam action. Accordingly, some contact between the cartridge and the bolt body is maintained at all times in the illustrated embodiment when the bolt is in the closed breech position regardless of whether the breech is locked or unlocked.

The bolt 40 may be formed of any suitably strong metal capable of withstanding repeated cartridge loading and unloading cycles as well as combustion forces generated by discharging the rifle 20. In one non-limiting embodiment, the bolt is made of a suitable steel material.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A firearm with bolt assembly, the firearm comprising:

a longitudinal axis;

a magazine well;

a receiver defining a longitudinally extending cavity in communication with the magazine well;

a barrel supported by the receiver and including a rear end and a front end;

an ammunition magazine removably supported by the magazine well, the magazine including a pair of feed lips for retaining a plurality of cartridges in the magazine; and a manually rotatable bolt disposed in the cavity of the receiver, the bolt movable forward to a closed breech position in battery with the barrel and rearward to an open breech position spaced apart from the barrel, the bolt including:

a bolt body including a longitudinal centerline, front section, rear section, and middle section extending therebetween;

the middle section being positioned over the feed lips of the magazine when the bolt is in the closed position;

a bolt head rigidly disposed on and extending forwardly from the front section of bolt body, the bolt head comprising a plurality of radial bolt lugs which are non-rotatable relative to the front section;

the middle section of the bolt body having a dimensionally reduced configuration comprising a recessed area positionable over and receiving a portion the feed lips of the magazine when the bolt is in the closed breech position to allow the bolt body to be rotated between locked and unlocked breech positions without interference from the feed lips;

wherein the recessed area comprises a downwardly open portion and at least one contiguous laterally open portion extending substantially above the longitudinal centerline of the bolt body.

2. The firearm according to claim 1, wherein the middle section of the bolt body has a smaller height than the front section.

3. The firearm according to claim 1, wherein the middle section of the bolt body has at least one smaller transverse cross-sectional dimension than the front section.

4. The firearm according to claim 1, wherein the bolt lugs have terminal ends which do not substantially project transversely outwards from the bolt body beyond an outer diameter of the front section of the bolt body.

5. The firearm according to claim 1, wherein the bolt lugs have terminal ends defining a reference bolt lug rotation circle which is substantially coextensive with an outer diameter of the front section of the bolt body.

6. The firearm according to claim 1, wherein part of the front section of the bolt body is positioned forward of the feed lips and located in a position that is below a top end of the feed lips when the bolt is in the closed breech position with the bolt rotated into the unlocked breech position for retraction.

7. The firearm according to claim 1, wherein one lateral side of the middle section of the bolt body comprises a greater transverse dimensional reduction in the bolt body than an opposing lateral side of the middle section.

8. The firearm according to claim 1, wherein the middle section includes a flat side surface formed on the bolt body that at least partially faces downwards towards the feed lips of the magazine when the bolt is axially in the closed breech position and rotated to the locked breech position.

9. The firearm according to claim 1, wherein the middle section includes an axially elongated planar bottom surface.

10. The firearm according to claim 1, wherein the front section of the bolt body includes a downwardly extending projection which defines a bottom stub surface having a lateral width smaller than a lateral gap formed between the feed lips of the magazine, the stub surface being slideable forward and rearward between the feed lips when the bolt is moved between the open breech and closed breech positions.

11. The firearm according to claim 10, further comprising an angled cartridge ramp forming a transition between the stub surface and a bottom surface of the middle section, the ramp being obliquely angled to a longitudinal centerline of the bolt body.

12. The firearm according to claim 11, wherein the angled cartridge ramp is operable to engage an uppermost cartridge in the magazine positioned between the feed lips and force the uppermost cartridge downwards when the bolt is retracted rearwardly from the closed breech position to the open breech position.

13. The firearm according to claim 11, wherein the bottom surface of the middle section and the stub surface are oriented parallel to the longitudinal centerline of the bolt body.

14. The firearm according to claim 1, further comprising a plurality of locking lugs disposed at a front end of the receiver which are selectively engaged by the bolt lugs when the bolt is in the closed and locked breech positions.

15. The firearm according to claim 1, wherein the bolt has a solid unitary construction including the bolt lugs which are rotatable in unison with the bolt body.

16. The firearm according to claim 1, wherein portions of the recessed area extend upwards on each lateral side of the bolt body forming a second contiguous laterally open portion opposite the at least one contiguous laterally open portion.

17. The firearm according to claim 16, wherein the second contiguous laterally open portion extends upwards to at least a point closer to the longitudinal centerline of the bolt body than a bottom surface of the bolt body.

18. The firearm according to claim 1, wherein a top of the laterally open portion of the recessed area is upwardly open.

19. The firearm according to claim 1, wherein the magazine is a double stack magazine, and the dimensionally reduced configuration of the middle section is dimensioned to provide the clearance between the bolt body and the feed lips of the double stack magazine when the bolt is in the closed breech position such that the bolt is rotatable between the locked breech position and the unlocked breech position without interference from the feed lips.

20. The firearm according to claim 1, wherein the dimensionally reduced configuration of the middle section within the recessed area does not include any flat surfaces.

21. The firearm according to claim 1, wherein the middle section comprises an arcuately curved convex transverse cross sectional profile having a constant curvature.

22. The firearm according to claim 21, wherein a top of the laterally open portion of the recessed area is upwardly open.

23. The firearm according to claim 1, wherein the laterally open portion of the recessed area extends upward to at least a point closer to a top of the middle section of the bolt body than the longitudinal centerline.

24. The firearm according to claim 1, wherein the at least one contiguous laterally open portion has a greater reduction in bolt body material than the downwardly open portion.

25. A bolt-action firearm with bolt assembly, the firearm comprising:

a longitudinal axis a receiver defining a longitudinally extending cavity;

a barrel supported by the receiver and including a rear end and a front end;

a double stack ammunition magazine removably disposed in the receiver and including a pair of laterally spaced apart feed lips for retaining a staggered stack of cartridges in the magazine; and a manually rotatable bolt disposed in the cavity and slideably movable forward to a closed breech position in battery with the barrel and rearward to an open breech position axially spaced apart from the barrel, the bolt including:

a longitudinal centerline;

a front section, a rear section, and a middle section extending therebetween;

the middle section defining a downwardly and laterally open recessed area positioned over the feed lips of the magazine when the bolt is in both the closed and locked breech positions, the recessed area receiving a portion of the feed lips therein;

a plurality of bolt lugs selectively engageable with a plurality of locking lugs at the rear end of the barrel, the bolt being rotatable between a locked breech position in which the bolt lugs engage the locking lugs and unlocked breech position in which the bolt lugs disengage the locking lugs when the bolt is in the closed position;

a bolt handle disposed on one lateral side of the bolt body for manually moving the bolt between the open and closed positions; and the front section of the bolt including a downwardly extending projection defining an axially oriented bottom stub surface;

the stub surface being dimensioned and operable to pass axially forward and rearward between the feed lips of the magazine when the bolt is moved between the open and closed breech positions;

wherein the recessed area of the middle section of the bolt body provides clearance between the bolt body and the feed lips of the magazine when the bolt is in the closed breech position to enable the bolt to rotate between the locked and unlocked breech positions without interference from the feed lips.

26. The firearm according to claim 25, further comprising a planar surface formed on a lateral side of the middle section of the bolt body closest to the bolt handle, wherein the planar surface provides clearance between the bolt and the feed lips of the magazine when the bolt is in the closed breech position so that the bolt is rotatable between the locked and unlocked breech positions.

27. The firearm according to claim 26, wherein portions of the planar surface are disposed in both an upper half and a lower half of the bolt body.

28. The firearm according to claim 25, wherein the stub surface is positioned and operable to contact and push the stack of cartridges downwards in the magazine when the bolt is moved rearward to the open breech position from the closed breech position.

29. The firearm according to claim 28, wherein one of the bolt lugs defines a feed lug axially aligned with the stub surface, the feed lug being operable to engage and hold the stack of cartridges downwards after the stub surface passes to the rear of the feed lips when the bolt is moved rearward to the open breech position.

30. The firearm according to claim 29, wherein the feed lug extends below top ends of the feed lips when the bolt is rotated into the unlocked breech position for stripping and feeding cartridges from the magazine into the barrel when the bolt is moved from the open breech position to the closed breech position.

31. The firearm according to claim 29, wherein the stub surface is axially aligned with the feed lug, the stub surface lying in substantially a same plane as an outermost end surface of the feed lug.

32. The firearm according to claim 25, wherein the middle section of the bolt body is multifaceted comprising a plurality of intersecting planar angled surfaces arranged circumferentially around the middle section.

33. The firearm according to claim 25, wherein the middle section is a dimensionally reduced section of the bolt body having a smaller height than the front section.

34. The firearm according to claim 25, wherein the recessed area comprises a downwardly open portion and at least one contiguous laterally open portion extending substantially above the longitudinal centerline of the bolt body.

35. A bolt-action firearm with bolt assembly, the firearm comprising:

a longitudinal axis a receiver defining a longitudinally extending cavity;

a barrel supported by the receiver and including a rear end and a front end;

an ammunition magazine removably disposed in the receiver and including a pair of feed lips for retaining a plurality of cartridges in the magazine; and a manually rotatable bolt disposed in the cavity and slideably movable forward to a closed breech position in battery with the barrel and rearward to an open breech position axially spaced apart from the barrel, the bolt including:

a plurality of bolt lugs selectively engageable with a plurality of locking lugs at the rear end of the barrel;

a bolt body including a front section, rear section, and middle section extending therebetween, the middle section comprising a dimensionally reduced portion of the bolt body having a smaller height than an outer diameter of the front section;

the bolt lugs being non-rotatable relative to the bolt body;

a bolt handle operably coupled to the bolt body for manually moving the bolt axially between the open and closed positions;

the middle section of the bolt body comprising a recessed area positionable over and receiving a portion the feed lips of the magazine when the bolt is in the closed breech position;

wherein the recessed area comprises a downwardly open portion and at least one contiguous laterally open portion extending substantially above the longitudinal centerline of the bolt body;

wherein the middle section provides clearance between the bolt body and the feed lips of the magazine when the bolt is in the closed breech position so that the bolt is rotatable via the bolt handle between a locked breech position and unlocked breech position.

36. The firearm according to claim 35, wherein the middle section of the bolt body has a smaller height than an outer diameter of the rear section.

37. The firearm according to claim 35, wherein a top surface of the middle section of the bolt body is substantially flush with the front section.

38. The firearm according to claim 37, wherein the top surface of the middle section of the bolt body is substantially flush with the rear section.

39. The firearm according to claim 35, wherein the middle section comprises the recessed area positioned over the feed lips of the magazine when the bolt is in the closed breech position, and wherein the recessed area of the middle section of the bolt body provides clearance between the bolt body and the feed lips of the magazine when the bolt is in the closed breech position to enable the bolt to rotate between the locked and unlocked breech positions without interference from the feed lips.

40. A bolt-action firearm with bolt assembly, the firearm comprising:

a longitudinal axis;

a magazine well;

a receiver defining a longitudinally extending cavity in communication with the magazine well;

a barrel supported by the receiver and including a rear end and a front end;

an ammunition magazine removably supported by the magazine well, the magazine including a pair of feed lips for retaining a plurality of cartridges in the magazine; and a bolt slideably movable in the cavity of the receiver between a forward closed breech position in battery with the barrel and rearward open breech position spaced away from the barrel, the bolt being manually rotatable via a bolt handle between the locked breech position and the unlocked breech position;

the bolt including:

a bolt body including a front section, rear section, and middle section extending therebetween;

the middle section defining a recessed area positioned over the feed lips of the magazine when the bolt is in the closed breech position, the recessed area receiving a portion of the feed lips therein;

a bolt head extending forwardly from the front section of bolt body, the bolt head comprising a plurality of radial bolt lugs structured such that the bolt lugs are non-rotatable relative to the front section; and a bolt handle attached to the bolt body;

wherein the recessed area comprises a downwardly open portion and at least one contiguous laterally open portion extending substantially above the longitudinal centerline of the bolt body;

wherein the recessed area of the middle section of the bolt body provides clearance between the bolt body and the feed lips of the magazine when the bolt is in the closed breech position to enable the bolt to rotate between a locked and unlocked breech positions without interference from the feed lips.

41. The firearm according to claim 40, wherein the recessed area comprises the middle section having a reduced diameter in comparison to the front section to avoid interference with the feed lips when the bolt is in the closed breech position and rotated.

42. The firearm according to claim 40, wherein the recessed area comprises a flat lateral surface on the middle section of the bolt.

43. The firearm according to claim 40, wherein at least some of the cartridges in the magazine are arranged in a double-stacked arrangement.

44. A firearm with bolt assembly, the firearm comprising:

a longitudinal axis;

a magazine well;

a receiver defining a longitudinally extending cavity in communication with the magazine well;

a barrel supported by the receiver and including a rear end and a front end;

an ammunition magazine removably supported by the magazine well, the magazine including a pair of feed lips for retaining a plurality of cartridges in the magazine; and a bolt slideably movable in the cavity of the receiver between a forward closed breech position in battery with the barrel and rearward open breech position spaced away from the barrel, the bolt being manually rotatable via a bolt handle between a locked breech position and unlocked breech position;

the bolt including:

a bolt body including a front section, rear section, and middle section extending therebetween, the middle section having a smaller height than the front or rear section;

the middle section defining a recessed area positioned over the feed lips of the magazine when the bolt is in the closed breech position, the recessed area receiving a portion of the feed lips therein;

a bolt head extending forwardly from the front section of bolt body, the bolt head comprising a plurality of radial bolt lugs structured such that the bolt lugs are non-rotatable relative to the front section; and a bolt handle attached to the bolt body;

wherein the recessed area comprises a downwardly open portion and at least one contiguous laterally open portion extending substantially above the longitudinal centerline of the bolt body;

wherein the bolt is manually rotatable when in the closed breech position between a locked breech position and unlocked breech position without interference from the middle section of the bolt body.

* * * * *